US010758784B2

(12) United States Patent
Madson et al.

(10) Patent No.: US 10,758,784 B2
(45) Date of Patent: Sep. 1, 2020

(54) DIMPLE PATTERNS WITH SURFACE TEXTURE FOR GOLF BALLS

(71) Applicant: Acushnet Company, Fairhaven, MA (US)

(72) Inventors: Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/381,156

(22) Filed: Apr. 11, 2019

(65) Prior Publication Data

US 2019/0232115 A1 Aug. 1, 2019

Related U.S. Application Data

(63) Continuation-in-part of application No. 15/811,790, filed on Nov. 14, 2017, now Pat. No. 10,328,310, (Continued)

(51) Int. Cl.
*A63B 37/00* (2006.01)
*A63B 37/14* (2006.01)

(52) U.S. Cl.
CPC ..... *A63B 37/0019* (2013.01); *A63B 37/002* (2013.01); *A63B 37/0004* (2013.01); *A63B 37/0005* (2013.01); *A63B 37/0006* (2013.01); *A63B 37/009* (2013.01); *A63B 37/0011* (2013.01); *A63B 37/0012* (2013.01); *A63B 37/0015* (2013.01); *A63B 37/0018* (2013.01); *A63B 37/0021* (2013.01); *A63B 37/0089* (2013.01); *A63B 37/0096* (2013.01); *A63B 37/14* (2013.01)

(58) Field of Classification Search
CPC ..... A63B 37/0019; A63B 37/0011; A63B 37/0004; A63B 37/0005; A63B 37/0012; A63B 37/14
See application file for complete search history.

(56) References Cited

U.S. PATENT DOCUMENTS 4,284,276 A 8/1981 Worst
4,787,638 A 11/1988 Kobayashi
(Continued)

*Primary Examiner* — John E Simms, Jr.
(74) *Attorney, Agent, or Firm* — Margaret C. Barker

(57) ABSTRACT

Golf ball comprising dimple(s) incorporating three or more linear channels having the same channel length L and same channel width CW; all linear channels extend radially outward from a centroid of the dimple toward a perimeter of the dimple without intersecting the dimple's centroid. Each linear channel may extend radially outward from a location on the dimple that is a distance Cd from the dimple's centroid, wherein Cd>0. Alternatively, at least one of the three or more linear channels has a different channel length L and/or a different channel width CW than at least one other linear channel. Dimple may have circular or non-circular plan shape; channels may not intersect each other; at least one linear channel may intersect the dimple's perimeter; and linear channels may be spaced by n separation angles $\theta_S$, wherein n is number of linear channels, which may be equal, or at least two differ.

18 Claims, 19 Drawing Sheets

Related U.S. Application Data which is a continuation-in-part of application No. 15/230,811, filed on Aug. 8, 2016, now Pat. No. 9,844,701, which is a continuation-in-part of application No. 15/047,785, filed on Feb. 19, 2016, now Pat. No. 9,713,746, which is a continuation of application No. 14/476,843, filed on Sep. 4, 2014, now Pat. No. 9,302,155.

(56) References Cited

U.S. PATENT DOCUMENTS

| | | | | |
|---|---|---|---|---|
| 5,547,197 | A | 8/1996 | Pocklington | |
| 5,879,245 | A * | 3/1999 | Hwang | A63B 37/0004 473/384 |
| 6,176,793 | B1 | 1/2001 | Sullivan | |
| 6,475,106 | B1 | 11/2002 | Green et al. | |
| 6,569,038 | B2 | 5/2003 | Sullivan | |
| 7,041,013 | B2 | 5/2006 | Ohama et al. | |
| 7,226,369 | B2 | 6/2007 | Aoyama et al. | |
| 7,250,012 | B1 | 7/2007 | Simonds | |
| 7,273,426 | B2 | 9/2007 | Sato et al. | |
| 7,326,131 | B2 | 2/2008 | Sajima et al. | |
| 7,354,359 | B2 | 4/2008 | Sajima | |
| 7,468,007 | B2 | 12/2008 | Simonds et al. | |
| 7,503,857 | B2 | 3/2009 | Kasashima et al. | |
| 7,618,332 | B2 | 11/2009 | Sato et al. | |
| 7,722,484 | B2 | 5/2010 | Morgan et al. | |
| 7,867,109 | B2 | 1/2011 | Sullivan et al. | |
| 8,329,081 | B2 | 12/2012 | Morgan et al. | |
| 2001/0019974 | A1 | 9/2001 | Hanada | |
| 2002/0165044 | A1 * | 11/2002 | Sullivan | A63B 37/0004 473/378 |
| 2003/0211903 | A1 | 11/2003 | Hanada | |
| 2004/0127306 | A1 | 7/2004 | Sato | |
| 2006/0281583 | A1 | 12/2006 | Sato et al. | |
| 2008/0261725 | A1 * | 10/2008 | Olson | A63B 37/0007 473/384 |
| 2009/0280929 | A1 | 11/2009 | Doot | |
| 2012/0046132 | A1 | 2/2012 | Fitchett et al. | |
| 2012/0165130 | A1 | 6/2012 | Madson et al. | |
| 2012/0301617 | A1 | 11/2012 | Fitchett et al. | |
| 2013/0072325 | A1 | 3/2013 | Madson et al. | |
| 2013/0168896 | A1 | 7/2013 | Tutmark | |
| 2016/0067552 | A1 * | 3/2016 | Hixenbaugh | A63B 37/0015 473/383 |
| 2016/0271456 | A1 * | 9/2016 | Hwang | A63B 37/0007 |
| 2018/0339201 | A1 | 11/2018 | Sato et al. | |

* cited by examiner

SECTION A-A

DIMPLE PATTERNS WITH SURFACE TEXTURE FOR GOLF BALLS

CROSS-REFERENCE TO RELATED APPLICATIONS

The present application is a continuation-in-part of U.S. application Ser. No. 15/811,790, filed, Nov. 14, 2017, currently pending and allowed, which is a continuation-in-part of U.S. application Ser. No. 15/230,811, filed, Aug. 8, 2016, and issued as U.S. Pat. No. 9,844,701, which is a continuation-in-part of U.S. application Ser. No. 15/047,785, filed, Feb. 19, 2016, and issued as U.S. Pat. No. 9,713,746, which is a continuation of U.S. application Ser. No. 14/476,843, filed on Sep. 4, 2014 and issued as U.S. Pat. No. 9,302,155, the disclosures of which are hereby incorporated by reference herein in their entireties.

FIELD OF THE INVENTION

This invention relates to golf balls, particularly to golf balls possessing unique dimple patterns including surface texture. More particularly, the invention relates to golf balls having dimples arranged on the outer surface for primary aerodynamic behavior and flight characteristics and surface texture for secondary aerodynamic behavior and/or for creating visually distinct appearance.

BACKGROUND OF THE INVENTION

Historically, dimple patterns for golf balls have had a variety of geometric shapes, patterns, and configurations. Primarily, patterns are laid out in order to provide desired performance characteristics based on the particular ball construction, material attributes, and player characteristics influencing the ball's initial launch angle and spin conditions. Therefore, dimple pattern development is a secondary design step that is used to achieve the appropriate aerodynamic behavior, thereby tailoring ball flight characteristics and performance attributes.

Aerodynamic forces generated by a ball in flight are a result of its velocity and spin. These forces can be represented by a lift force and a drag force. Lift force is perpendicular to the direction of flight and is a result of air velocity differences above and below the rotating ball. This phenomenon is attributed to Magnus, who described it in 1853 after studying the aerodynamic forces on spinning spheres and cylinders, and is described by Bernoulli's Equation, a simplification of the first law of thermodynamics. Bernoulli's equation relates pressure and velocity where pressure is inversely proportional to the square of velocity. The velocity differential, due to faster moving air on top and slower moving air on the bottom created by the ball's spin, results in lower air pressure on top and an upward directed force on the ball.

Drag is opposite to the direction of flight and orthogonal to lift. The overall drag force on a ball is attributed pressure drag and viscous or skin friction drag. A sphere is a bluff body, which is a somewhat inefficient aerodynamic shape. As a result, the accelerating flow field around the ball causes a large pressure differential with high-pressure forward and low-pressure behind the ball. The low pressure area behind the ball is also known as the wake. In order to minimize pressure drag, dimples provide a means to energize the flow field and delay the separation of flow, or reduce the wake region behind the ball. Skin friction is a viscous effect residing close to the surface of the ball within the boundary layer.

The industry has seen many efforts to maximize the aerodynamic efficiency of golf balls, through dimple distribution and other methods, though they are closely controlled by golf's national governing body, the United States Golf Association (U.S.G.A.). One U.S.G.A. requirement is that golf balls have aerodynamic symmetry. Aerodynamic symmetry allows the ball to fly with a very small amount of variation no matter how the golf ball is oriented when tested. Preferably, dimples cover the maximum surface area of the golf ball without detrimentally affecting the aerodynamic symmetry of the golf ball and the ability of the ball to roll smoothly.

In attempts to improve aerodynamic symmetry, many dimple patterns have been developed based on geometric shapes. These may include circles, hexagons, triangles, and the like. Other dimple patterns are based in general on the five Platonic Solids including icosahedron, dodecahedron, octahedron, cube, or tetrahedron. Yet other dimple patterns are based on the thirteen Archimedian Solids, such as the small icosidodecahedron, rhomicosidodecahedron, small rhombicuboctahedron, snub cube, snub dodecahedron, or truncated icosahedron. Furthermore, other dimple patterns are based on hexagonal dipyramids. Dimple properties such as number, shape, size, volume, edge angles and arrangement are often manipulated in an attempt to generate a golf ball that has improved aerodynamic properties.

Furthermore, secondary surface texture has been suggested to augment the dimples and further refine the aerodynamic properties of the ball. In fact, early golfers found that the feathery golf balls flew better after being played for a while. They then began to purposely roughen the surface to created improved aerodynamic properties.

Similarly, U.S. Pat. No. 4,787,638 to Kobayashi discloses a golf ball with a plurality of first dimples arranged substantially uniformly on the outer surface of the ball. The ball also includes a plurality of indentations which are smaller than the dimples and are also arranged substantially uniformly on the outer surface and inside the surfaces of the dimples. The indentations may be formed by grit blasting. Likewise, U.S. Publication No. 2012-0301617 teaches essentially the same micro surface roughness over the surface of the golf ball to affect aerodynamic properties of the ball.

U.S. Pat. No. 8,329,081 to Morgan discloses a method of forming a golf ball with secondary surface texture created on the fret areas of a ball. The secondary surface texture is created on the golf ball hob prior to the primary dimples being formed into the hob. When the dimples are formed, they largely obliterate the secondary surface texture except for the fret area and the perimeter of the dimples.

U.S. Pat. No. 6,569,038, to Sullivan discloses a ball having dimples with structures therein to energize or agitate the airflow over the dimpled surface to increase the aerodynamic performance of the ball. These structures include sub-dimples and radiating convex or concave arms emanating from the center of the dimple.

SUMMARY OF THE INVENTION

The present invention is directed to a golf ball having an outer surface comprising a plurality of dimples, wherein at least one of the dimples comprises three or more linear channels on the surface thereof having the same channel length L and the same channel width CW; wherein each of the linear channels extends radially outward in a direction from the centroid of the dimple toward the perimeter of the dimple without intersecting the centroid.

Thus, each linear channel may extend radially outward from a location on the dimple that is a distance Cd from the dimple's centroid, wherein Cd≥0.

Moreover, the three or more linear channels are spaced by n separation angles $\theta_S$, wherein n is the number of linear channels.

In one embodiment, all n separation angles $\theta_S$ are equal. In another embodiment, at least two of the n separation angles $\theta_S$ differ.

The linear channels may form a pattern that is axially symmetric about an axis connecting the centroid of the dimple and the center of the golf ball. Alternatively, the linear channels may form a pattern that is not axially symmetric about an axis connecting the centroid of the dimple and the center of the golf ball.

In one embodiment, none of the channels intersect each other. In a specific embodiment, at least one linear channel intersects the perimeter of the at least one dimple. In another embodiment, every linear channel intersects the perimeter of the at least one dimple.

In one embodiment, at least one dimple has a circular plan shape. In another embodiment, at least one dimple has a non-circular plan shape.

In a particular embodiment, channel length L is less than half of dimple diameter and at least two times channel width CW; wherein channel width CW is at least two times channel depth, wherein channel depth is less than or equal to 0.007 inches.

At least one dimple may comprise an even number of linear channels; wherein a first half of linear channels intersects a perimeter of the dimple and a second half of linear channels does not intersect the perimeter of the dimple; and wherein the first half of the linear channels and the second half of the linear channels alternate about the dimple's centroid.

At least one dimple may comprise nine linear channels; wherein none of the linear channels intersects the perimeter of the dimple, and wherein the linear channels are spaced by a separation angle $\theta_S$ of between 38.0 degrees and 42.0 degrees.

At least one dimple may comprise nine linear channels; wherein each linear channel intersects a perimeter of the dimple, and wherein the linear channels are spaced by a separation angle $\theta_S$ of between 38.0 degrees and 42.0 degrees.

In another embodiment, a golf ball of the invention has an outer surface comprising a plurality of dimples, wherein at least one of the dimples incorporates axially symmetric directional surface texturing comprised of three or more linear channels. At least one of the three or more linear channels has a different channel length L and/or a different channel width CW than at least one other linear channel; and each linear channel extends radially outward without intersecting the dimple's centroid; and linear channels having the same channel length L and the same channel width CW are spaced by n separation angles $\theta_S$, wherein n is the number of linear channels having the same channel length L and the same channel width CW.

In a particular such embodiment, the golf ball comprises a first type of linear channel and a second type of linear channel. Each linear channel of the first type has the same channel length $L_1$ and the same channel width $CW_1$ and extends radially outward from a location on the dimple that is a distance $Cd_1$ from the dimple's centroid, and are spaced about the centroid by a channel separation angle $\theta_{S1}$. Meanwhile, each linear channel of the second type has the same channel length $L_2$ and the same channel width $CW_2$ and extends radially outward from a location on the dimple that is a distance $Cd_2$ from the dimple's centroid, and are spaced about the centroid by a channel separation angle $\theta_{S2}$. The first type of linear channel and the second type of linear channel alternate about the dimple's centroid.

In one embodiment, $Cd_1=Cd_2$. In one such embodiment, either $L_1=L_2$, $CW_1=CW_2$, or $L_1=L_2$ and $CW_1=CW_2$.

In another embodiment, $Cd_2>Cd_1$. In a specific such embodiment, either $L_1=L_2$, $CW_1=CW_2$, or $L_1=L_2$ and $CW_1=CW_2$.

In one specific embodiment, linear channels of the first type do not intersect the perimeter of the dimple and linear channels of the second type intersect the perimeter of the dimple.

The dimple may comprise ten linear channels comprising five linear channels of the first type and five linear channels of the second type; wherein none of the ten linear channels intersects the perimeter of the dimple; and wherein separation angle $\theta_{S1}$ is between 70 degrees and 74 degrees, and separation angle $\theta_{S2}$ is between 70.0 degrees and 74.0 degrees.

The dimple may comprise twelve linear channels comprising six linear channels of the first type and six linear channels of the second type; wherein each of the twelve linear channels intersects the perimeter; and wherein separation angle $\theta_{S1}$ is between 58.0 degrees and 62.0 degrees and separation angle $\theta_{S2}$ is between 58.0 degrees and 62.0 degrees.

In one such embodiment, separation angle $\theta_{S1}$ is equal to separation angle $\theta_{S2}$. In another such embodiment, separation angle $\theta_{S1}$ is greater than separation angle $\theta_{S2}$.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

The present invention is directed to golf ball with improved dimples. The aerodynamic characteristics of a golf ball are largely dependent on the dimples of a golf ball and the way that the dimples are arrange. Golf balls typically include 250 to 450 dimples on the outer surface that range from about 0.08 to 0.2 inches in diameter, if circular. The way that these dimples are arranged over the outer surface, the shapes of the dimples and the edge angles of the dimples are all important to the overall flight performance of the golf ball.

Figure 1:
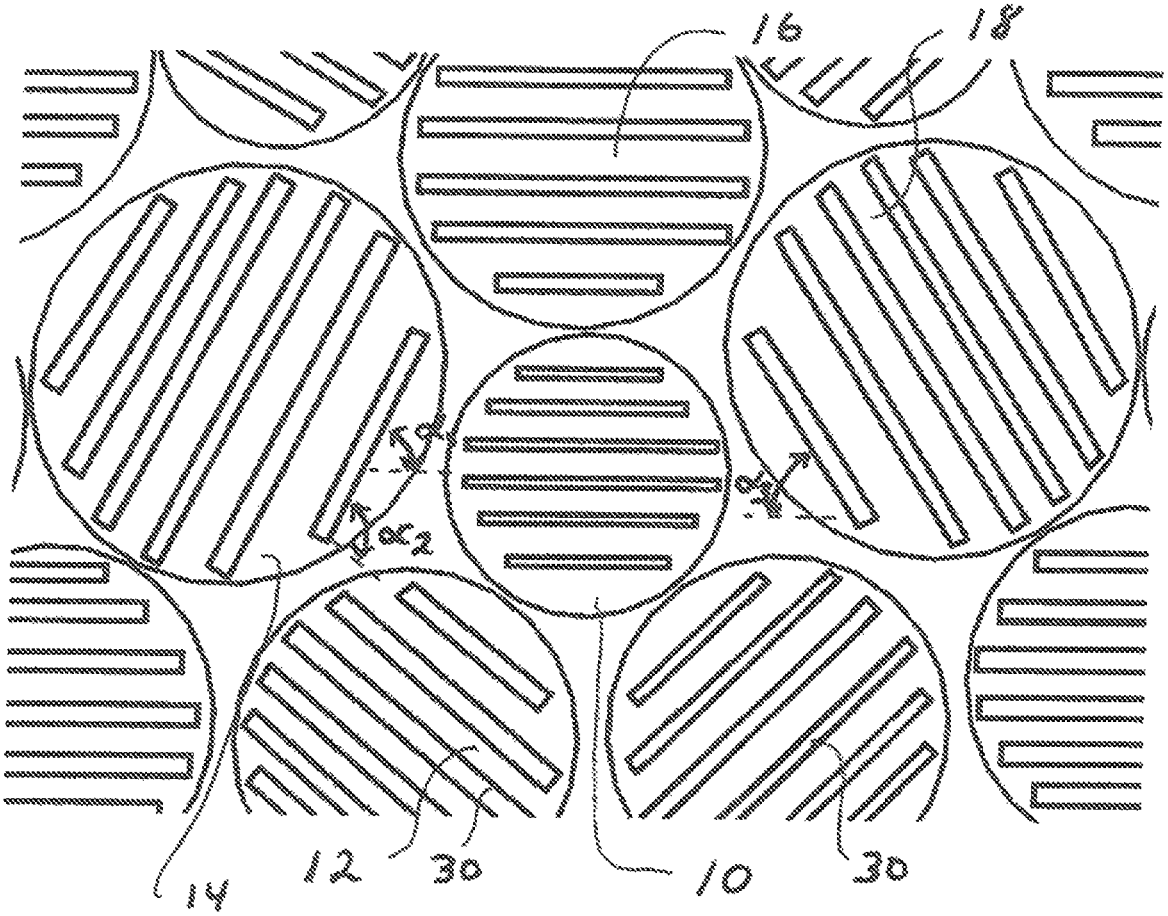
FIG. 1 illustrates a portion of a golf ball with directional surface texturing according to the present invention.

In FIG. 1, a plurality of dimples having directional surface texturing is disclosed. The dimples 10 through 20, for example, are adjacent dimples and have different dimple diameters. However, all of the dimples shown include a plurality of linear channels 30 therein.

Preferably, a golf ball according to the present invention has an outer surface comprising a plurality of dimples covering greater than 70 percent of the outer surface and at least 20 percent of the dimples incorporate directional surface texturing. Directional surface texturing is defined as a plurality of indentations or protrusions that form aligned arrangements within the dimple.

The outer surface of the golf ball preferably comprises less than 400 dimples of different sizes and, more preferably, at least 5 different sizes. In a preferred embodiment, at least 50 percent of the dimples incorporate directional surface texturing such as the linear channels 30 therein. The linear channels 30 are substantially parallel within the dimple. Preferably, there are between 2 and 6 linear channels within the dimples. Although FIG. 1 shows each of the dimples containing 6 linear channels, it is contemplated that smaller diameter dimples are likely to have less linear channels than larger diameter dimples. For example, in a preferred embodiment, a dimple having a diameter of less than 0.12 inch can have between 2 and 5 linear channels and a dimple having a diameter of 0.12 to 0.2 inch can have between 5 and 8 linear channels.

In a preferred embodiment of the invention, the outer surface of the golf ball comprises less than 360 dimples and all of the dimples incorporate directional surface texturing made up of substantially linear arrangements that are aligned. The linear arrangements, like the linear channels 30 disclosed in FIG. 1, are preferably substantially parallel to each other and extend across a substantial portion of the dimple. While the linear channels 30 shown in FIG. 1 are parallel within each dimple, they are at offset angles $\alpha$ with respect to adjacent dimples. The linear channels 30 within a dimple are disposed at angles of between about 10 and 90 degrees with respect to the linear channels 30 of an adjacent dimple. For example, dimple 10 includes linear channels that are disposed at an angle $\alpha$ of between 10 and 90 degrees with respect to each of the adjacent dimples 12, 14, 18 and 20. As shown, the linear channel angles $\alpha_1$ and $\alpha_2$ are about 60 degrees and $\alpha_3$ is about 90 degrees. Preferably, the linear channels 30 are arranged at an angle $\alpha$ of between about 30 and 90 degrees with respect to most of the adjacent dimples. In some arrangements, the golf ball can be designed such that no dimple on the ball has an adjacent dimple with parallel linear arrangements.

Figure 2:
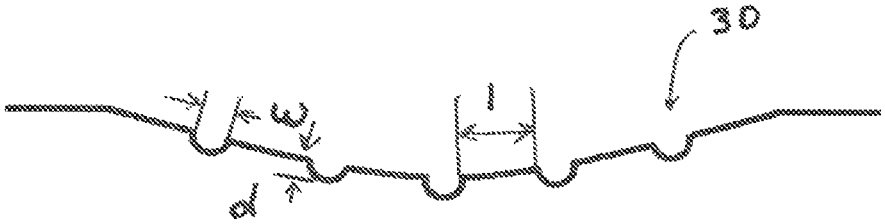
FIG. 2 illustrates a cross-sectional view of a dimple incorporating directional surface texturing according to the present invention.
Figure 7:
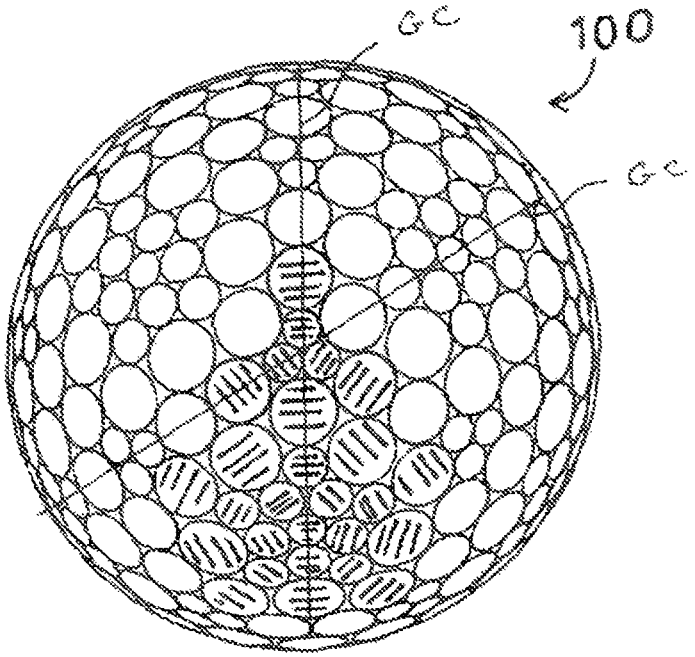
FIG. 7 illustrates a golf ball formed according to the present invention.

Referring to FIG. 2, a cross-section of a dimple is shown. The dimple depth, volume and edge angles of the dimples are measured as set forth in U.S. Pat. No. 7,226,369, as shown in FIG. 7 and discussed in col. 11, line 64 through, col. 12, line 46, which is incorporated by reference herein. The surface texturing is relatively small in comparison to the dimple and intended as a secondary aerodynamic function as discuss below. For example, preferably, the linear channels 30 have a maximum channel depth d of less than ¼ of a dimple depth. Linear protrusions within a dimple would be the inverse of the linear channels 30 shown. More preferably, the directional surface texturing depth (or protrusion height, if reversed) is less than about 0.002 inches. Also, the directional surface texturing has a width w, such as the channel width shown, that is equal to or greater than the depth and preferably greater than about twice the depth d. Further, the length between the directional surface texturing, shown as l, is preferably equal to or greater than the width w. Preferably, the length l is greater than twice the width w. Where FIG. 2 discloses a substantially U-shaped cross-section, it is preferred that the cross-section of the channels 30 be V-shaped, U-shaped, rectangular or other partial polygonal shape or any continuous curve defined by superposed curves such as those described in U.S. Publication No. 2012-0165130.

Further, the directional surface texturing is substantially elongated. The lengths of the directional surface texturing elements are preferably greater than 5 times the widths and extend substantially across the dimples. For example, the lengths of the linear channels 30 are preferably greater than 5 times the channel widths w and extend substantially across the dimples as shown. If a dimple is about 0.15 inches, the directional surface texturing in the center of the dimple preferably has a length of at least 0.1 inch, and more preferably, about 0.11-0.13 inch. The same directional surface texturing preferably has a width of less than about 0.02. Similarly, smaller dimples having a diameter of about 0.11 inch may have directional surface texturing with a length of about 0.08 to 0.09 inch. Preferably, the width of the directional surface texturing will be approximately the same as the surface texturing in the larger dimples. The table below is an example of a preferred dimple pattern incorporating linear channels as the directional surface texturing.

TABLE I

| Dimple Diameter (in) | Number of Dimples | Number of Channels/ Dimple | Channel Width (in) | Channel Depth (in) |
|---|---|---|---|---|
| 0.115 | 12 | 4 | 0.01 | 0.002 |
| 0.155 | 20 | 5 | 0.01 | 0.002 |
| 0.160 | 40 | 5 | 0.01 | 0.002 |
| 0.165 | 50 | 5 | 0.01 | 0.002 |
| 0.170 | 60 | 5 | 0.01 | 0.002 |
| 0.175 | 80 | 6 | 0.01 | 0.002 |
| 0.180 | 70 | 6 | 0.01 | 0.002 |

The present invention also provides a method for arranging dimples with directional surface texturing on a golf ball surface. The method includes creating sections on the surface of a golf ball. Preferably, the sections are polyhedrons or portions thereof and then filling the sections with dimples incorporating directional surface texturing. Each of the sections can contain a different arrangement of the directional surface texturing. For example, as discussed with FIG. 1 above, the dimples 10-20 all contain directional surface texturing that is oriented at an angle with respect to an adjacent dimple. This arrangement of the directional surface texturing provides that the ball has a uniform secondary aerodynamic characteristic regardless of the direction the ball is oriented.

Referring to FIGS. 3-12, a dimple pattern can be formed by choosing control points of a polyhedron, connecting the control points with a non-straight sketch line, patterning the sketch line in a first manner to generate an irregular domain, optionally patterning the sketch line in a second manner to create an additional irregular domain, packing the irregular domain(s) with dimples, and tessellating the irregular domain(s) to cover the surface of the golf ball in a uniform pattern. The control points can include the center of a polyhedral face, a vertex of the polyhedron, a midpoint or other point on an edge of the polyhedron, and others. The method ensures that the symmetry of the underlying polyhedron is preserved while minimizing or eliminating great circles due to parting lines from the molding process.

Figure 3:
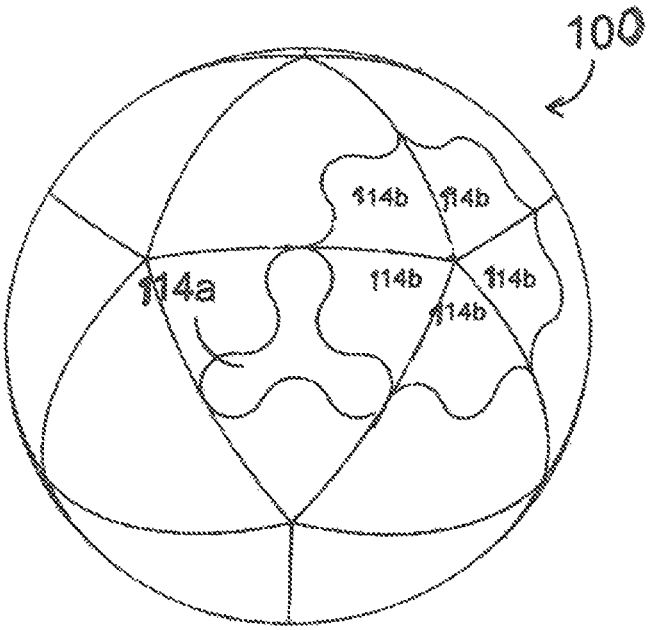
FIG. 3 illustrates a first domain and a second domain formed in an icosahedron face projected on a sphere.
Figure 4:
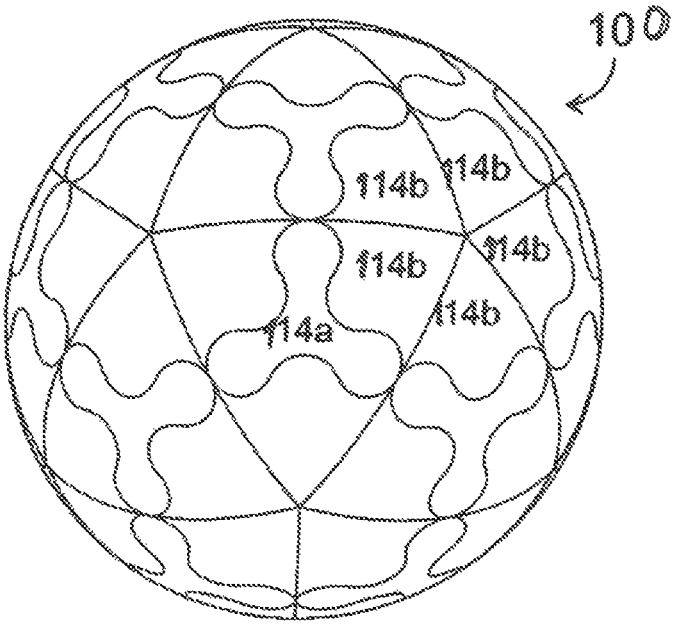
FIG. 4 illustrates the domains of FIG. 3 tessellated to cover the surface of a sphere.

Referring to FIGS. 3-7, a golf ball outer surface can be divided into equal sections by the projections of an icosahedron. Each icosahedron can then be divided by a midpoint to midpoint method, for example, to yield two domains that are tessellate to cover the surface of golf ball 100 as shown in FIGS. 3 and 4. The two domains are shown as 114*a* and 114*b*. The method of forming the different sections and then tessellating them over the surface of a golf ball to create different dimple patterns formed from such sections is set forth in U.S. application Ser. No. 13/675,041, which published as Publication No. 2013-0072325 on Mar. 21, 2013, and which is incorporated by reference in its entirety herein.

Figure 5:
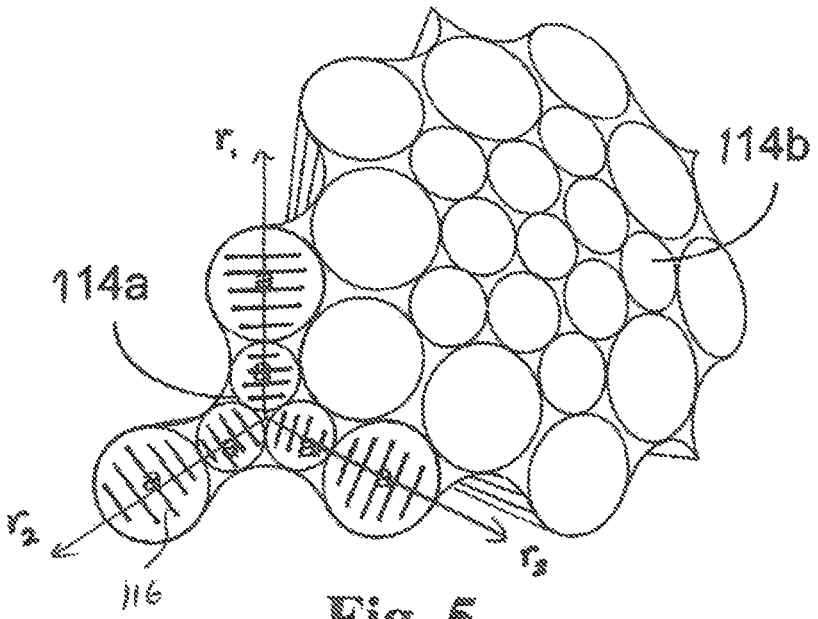
FIG. 5 illustrates a first portion of a golf ball dimple pattern formed according to the present invention.
Figure 6:
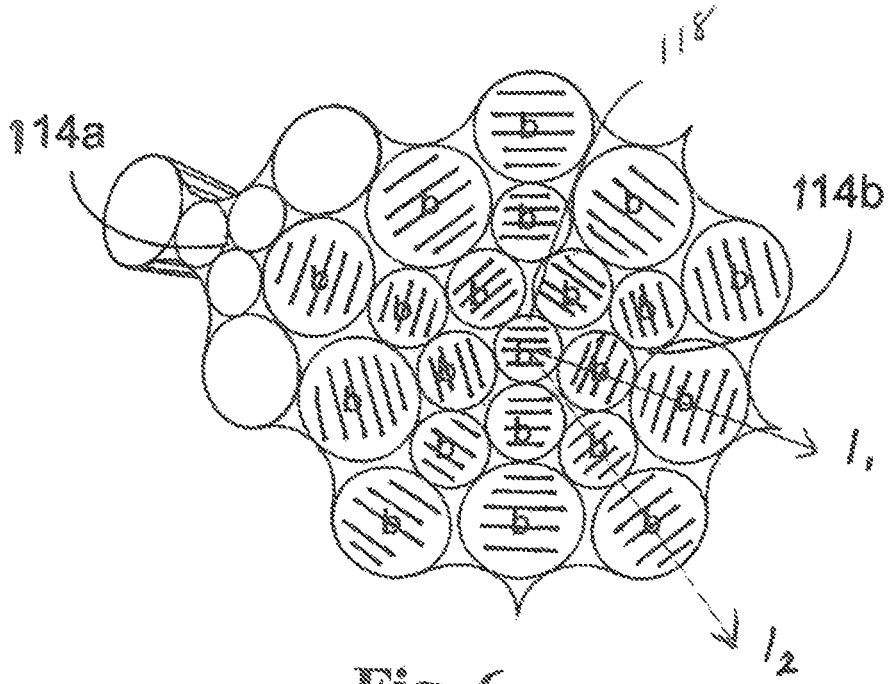
FIG. 6 illustrates a second portion of a golf ball dimple pattern formed according to the present invention.

Referring to FIGS. 5 and 6, the sections 114*a* and 114*b* are then filled with directional surface texturing. Elongated, linear protrusions 116 are formed within each dimple such that within the dimple, they are substantially parallel. The protrusions preferably have similar dimensions to the channels discussed above.

In a first section, set forth in FIG. 5, the directional surface texturing can be formed by selecting a midpoint of the section and then forming the linear elements perpendicular to the radii $r_1$-$r_3$ that emanate from the center. Similarly, in FIG. 6, the directional surface texturing is formed by forming protrusions that are perpendicular to the lines $l_1$ and $l_2$ emanating from the center dimple 118. In this manner, as shown in FIG. 7, each of the dimples in the sections will have an adjacent dimple with directional surface texturing at an angle between 10 and 90 degrees with respect thereto. This pattern will also form a plurality of great circles GC over the surface of the ball that intersect dimples incorporating directional surface texturing oriented perpendicular thereto.

Figure 8:
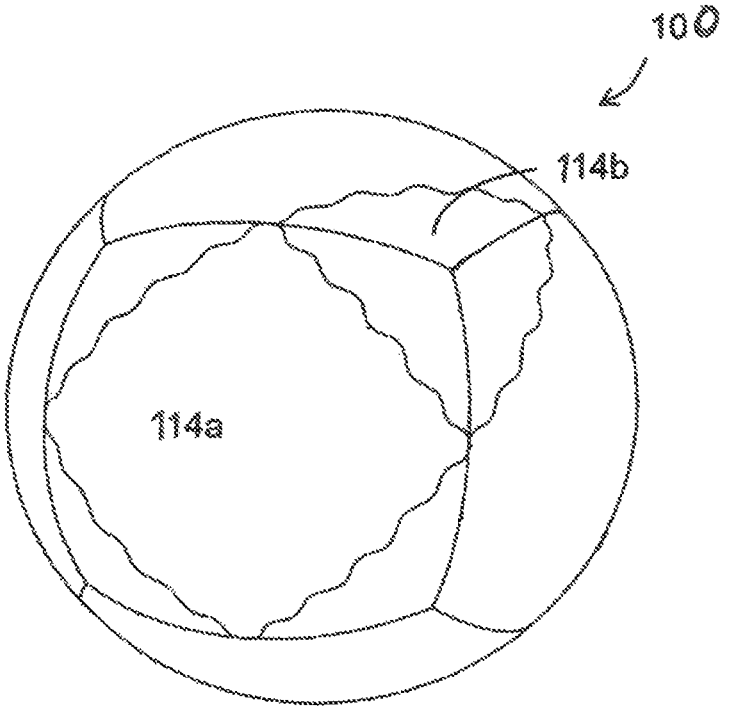
FIG. 8 illustrates a first domain and a second domain formed in a cube face projected on a sphere.
Figure 9:
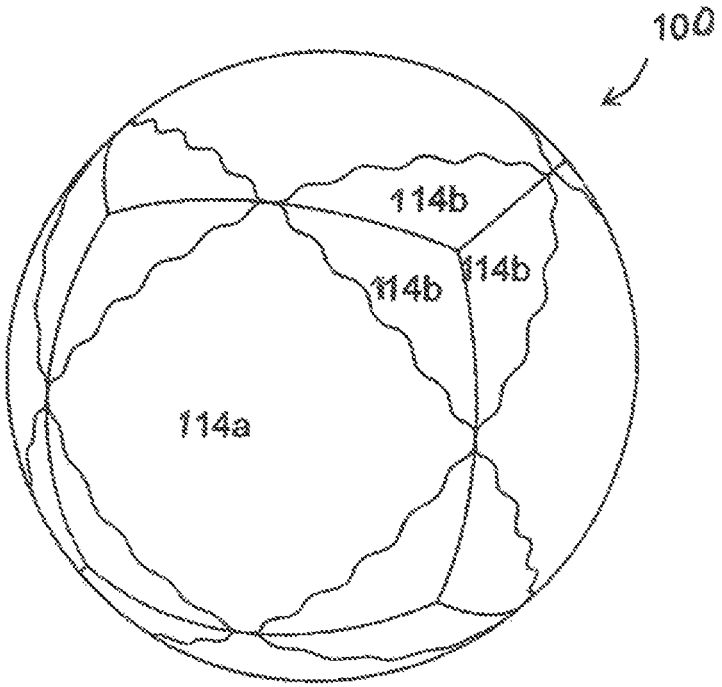
FIG. 9 illustrates the domains of FIG. 8 tessellated to cover the surface of a sphere.

Referring to FIGS. 8-12, a golf ball outer surface can be divided into equal sections by the projections of a cube. Each cube can then be divided by a midpoint to midpoint method, for example, to yield two domains that are tessellate to cover the surface of golf ball 100 as shown in FIGS. 8 and 9. The two domains are shown as 114*a* and 114*b*. Again, the method of forming the different sections and then tessellating them over the surface of a golf ball to create different dimple patterns formed from section is set forth in U.S. application Ser. No. 13/675,041.

Figure 10:
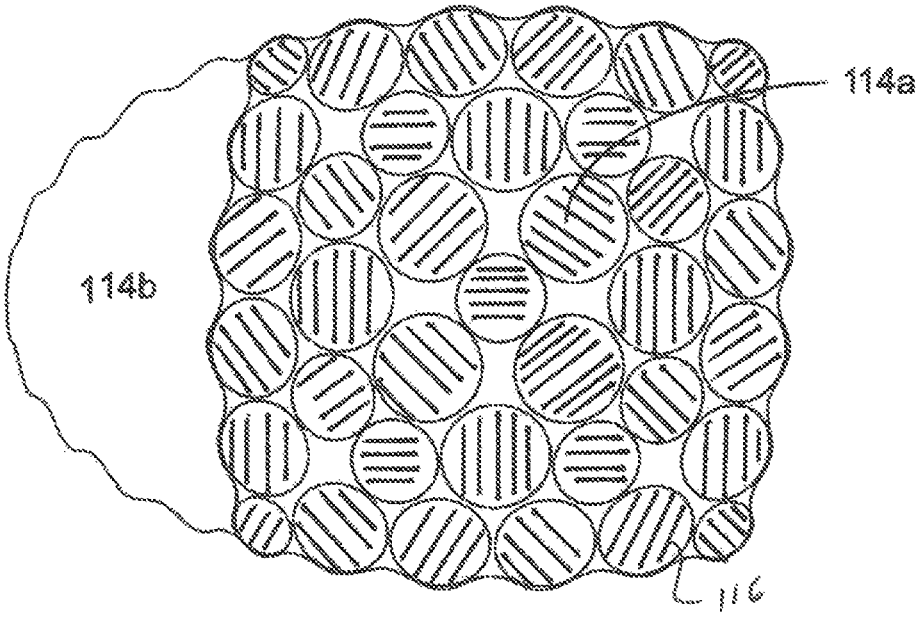
FIG. 10 illustrates a first portion of a golf ball dimple pattern formed according to the present invention.
Figure 11:
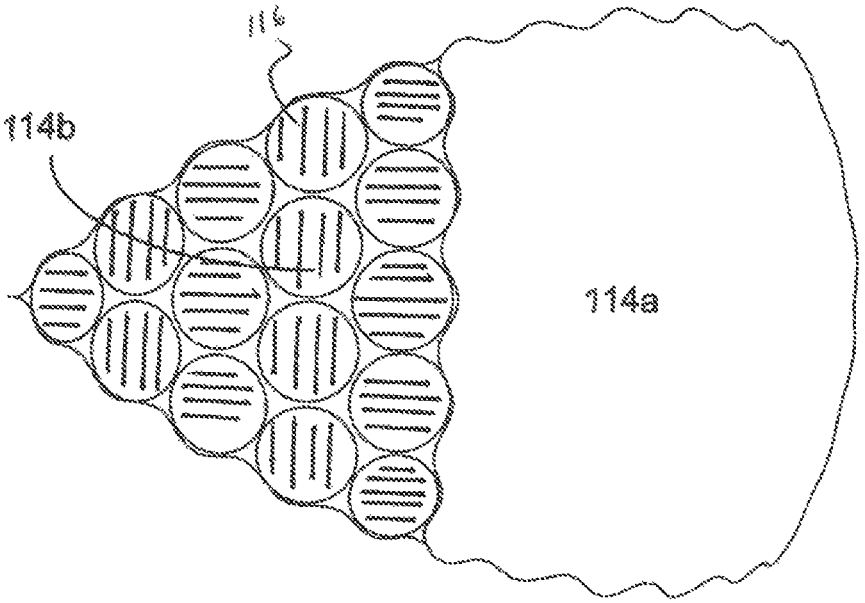
FIG. 11 illustrates a second portion of a golf ball dimple pattern formed according to the present invention.

Referring to FIGS. 10 and 11, the sections 114*a* and 114*b* are then filled with directional surface texturing 116. Elongated, linear protrusions 116 are formed within each dimple such that within the dimple, they are substantially parallel.

Figure 12:
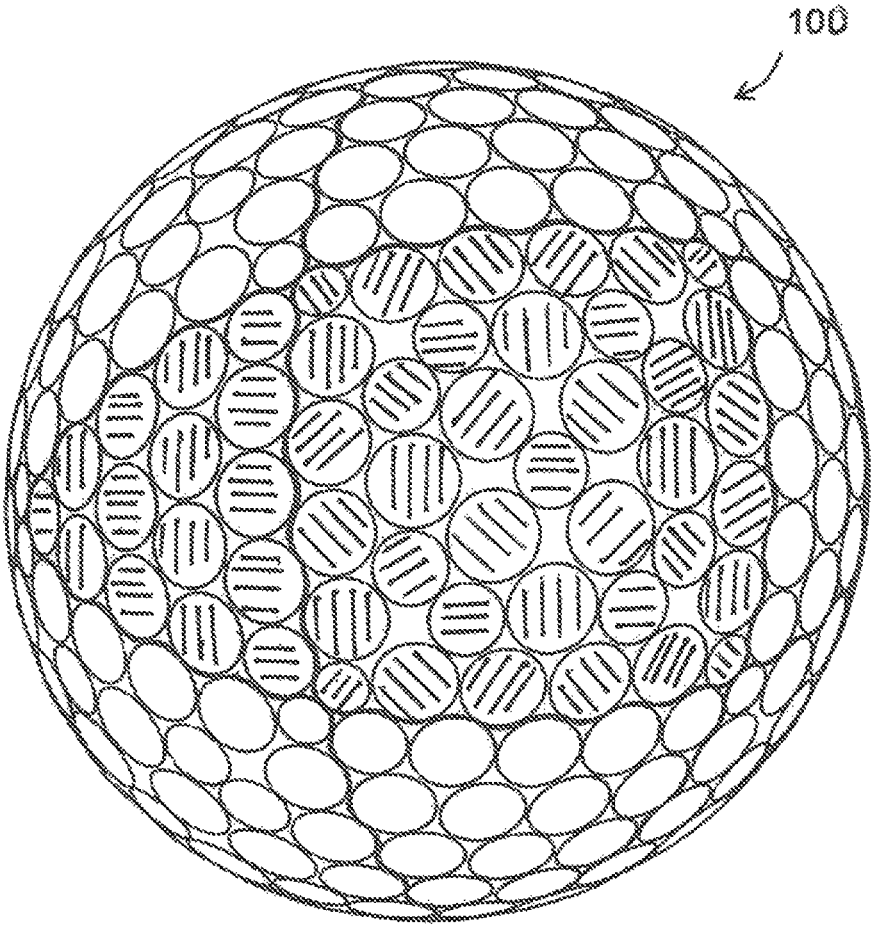
FIG. 12 illustrates a golf ball formed according to the present invention.

In a first section, set forth in FIG. 10, the directional surface texturing 116 can be formed by forming the linear elements 116 such that they are oriented at about 45 degree angles with respect to the directional surface texturing in an adjacent dimple. Similarly, in FIG. 11, the directional surface texturing 116 is formed by forming linear elements that are substantially perpendicular with respect to those in an adjacent dimple. As shown in FIG. 12, this type of arrangement results in an overall ball that has no great circles that intersect dimples having directional surface texturing that is perpendicular to the great circle. However, every dimple on the ball 100 still has an adjacent dimple with directional surface texturing at an angle of about 30 to 90 degrees relative thereto.

Furthermore, the present invention also contemplates an improvement in the aerodynamic characteristics of the golf ball. In particular, it is an object of the invention to improve the aerodynamics at low Reynolds Numbers and low Spin Ratios with the directional surface texturing. The aerodynamic properties of a golf ball and improvements in those properties are specifically discussed in detail in U.S. Pat. No. 7,226,369, and particularly in col. 4-col. 10 and col. 12-col. 17, which is incorporated by reference herein in its entirety. More particularly, the golf ball dimple pattern preferably comprises less than 370 dimples and more preferably less than 360 dimples covering over 75% of the outer surface of the ball and containing directional surface texturing within each dimple. More particularly, the golf ball preferably has a coefficient of lift at a Reynolds No. of 70,000 and Spin ration of 0.188 of greater than 0.24 and more preferably greater than 0.25. Moreover, the golf ball preferably has a coefficient of drag at a Reynolds No. of 70,000 and Spin Ratio of 0.188 of less than 0.27.

Figure 13:
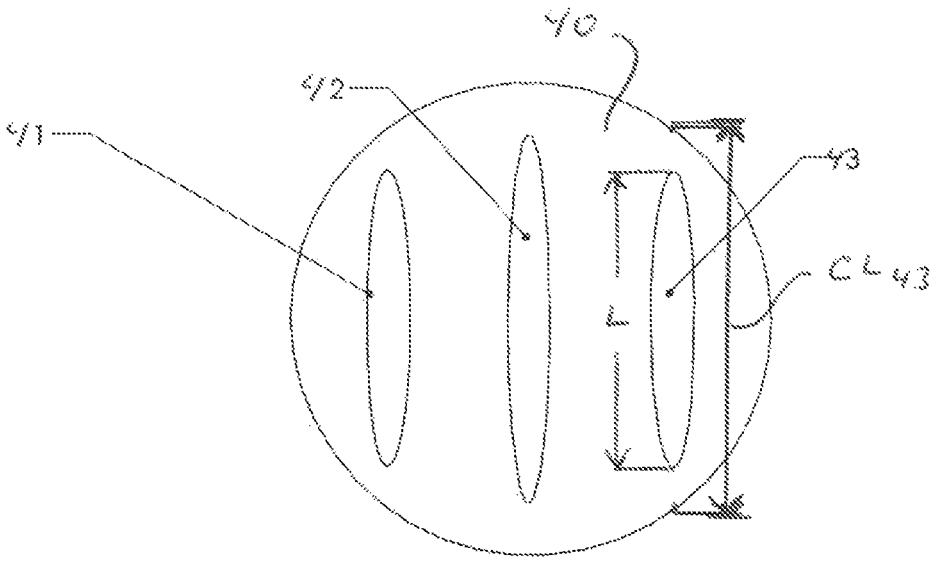
FIG. 13 illustrates a dimple having directional surface texturing.
Figure 14:
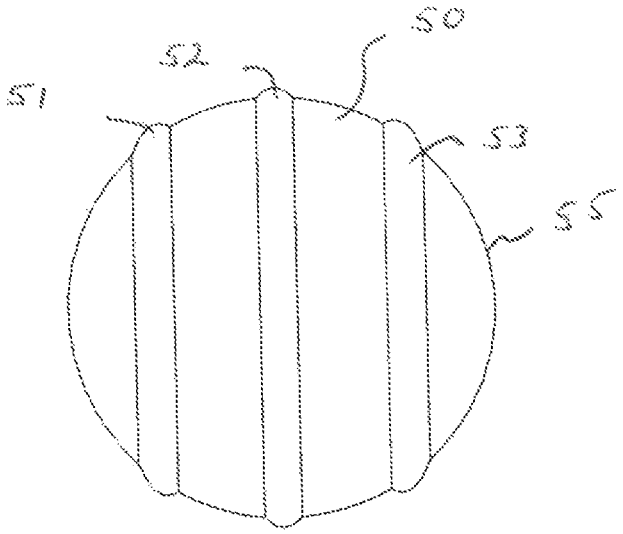
FIG. 14 illustrates a dimple having directional surface texturing.
Figure 15:
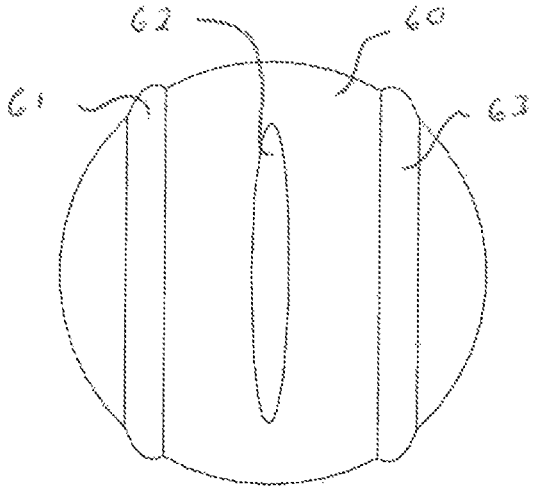
FIG. 15 illustrates a dimple having directional surface texturing.

Referring to FIGS. 13-16, dimples 40, 50 and 60 all have 3 or more substantially parallel linear channels (or protrusions) 41-43, 51-53 and 61-62, respectively. Preferably, the linear channels have a U-shaped cross-section with a depth of less than 0.005 inch and a radius of at least 0.001 inch. The channels are preferably formed by laser etching or machining the surface of the mold cavities that form the golf ball or by forming surface texturing on the hob that forms the mold cavities. In FIG. 13, the linear channels 41-43 do not extend across the dimple. Preferably, the channels have a length L that is greater than 50% of the chord length CL. For example, the linear channel 42, at the center of the dimple, extends greater than 50% of the dimple diameter. In FIG. 14, the linear channels 51-53 extend entirely across the width of the dimple and intersect the dimple perimeter 55. Preferably, the linear channels have a length that is less than about 110% of the chord length of the dimple. Thus, for all linear channels, it is preferred that they extend between 50% and 110% of the chord length of the dimple. More preferably, the linear channels have a length of between 80% and 105% of the dimple chord length extending through the length of the channel. Referring to FIG. 15, the dimple includes linear channels 61-63. The channel(s) 62 at the center of the dimple preferably does not extend across the width of the dimple such that it does not intersect an adjacent dimple. Thus the center channels, in this embodiment, can extend between about 50% and 95% of the dimple chord length (diameter). However, the perimeter channels, 61 and 63, extend greater than 100% of the chord length such that they would extend into fret area. Center linear channels are defined as those linear channels that are closer to the center of the dimple than the side perimeter, whereas perimeter linear channels are those channels that are closer to the side perimeter than the center. Preferably, the dimples and the linear channels cover at least 70% of the dimple outer surface, and more preferably, between 82% and 95%.

Figure 16:
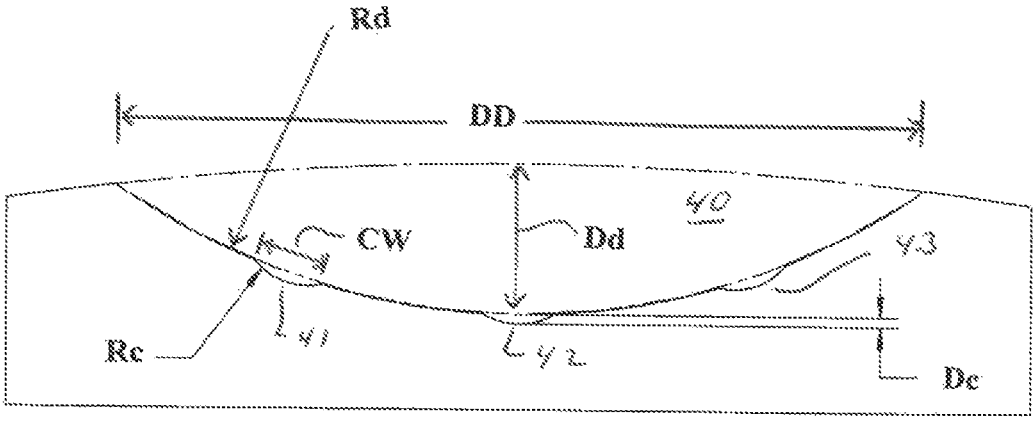
FIG. 16 illustrates a cross-section of a dimple having directional surface texturing.

Referring to FIG. 16, the dimples on the ball have a dimple radius Rd of at least 0.2 inch, and more preferably between about 0.2 inch and 1.4 inch. The linear channels have a channel radius Rc of between 0.001 inch and 0.08 inch. Furthermore, the linear channels have a channel depth Dc of between 0.0003 inch and 0.005 inch. More preferably, the linear channel depth Dc is between 0.0003 inch and 0.003 inch, and most preferably, between 0.0005 inch and 0.003 inch. In one embodiment, the linear channel depth Dc can be greater in the center linear channels than in the perimeter linear channels.

The dimples are preferably circular and have a dimple diameter DD of 0.11 inch to 0.22 inch, but the dimples could also be hexagons or other geometric shapes. The linear channels are relatively shallow compared to the depth of the dimple they are in, and preferably, have a channel depth Dc that is less than 1/10 of the dimple depth DD as measured from the phantom curved surface of the ball's outer surface.

Figure 17:
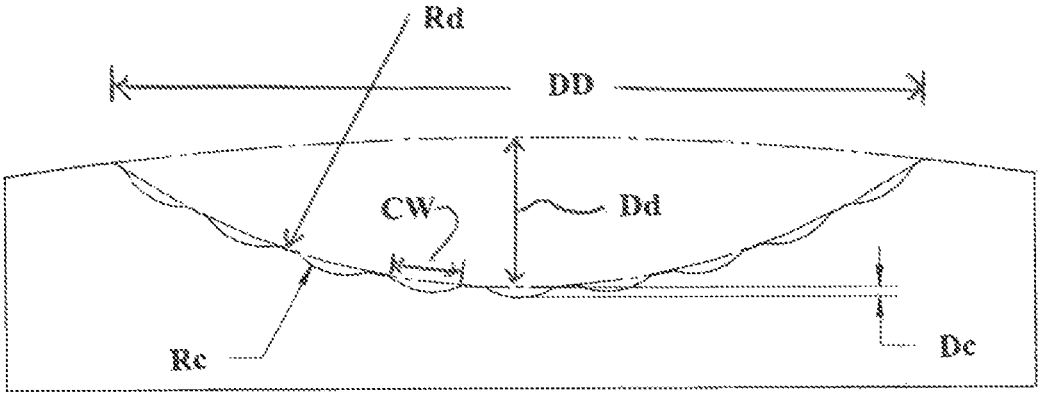
FIG. 17 illustrates a cross-section of a dimple having directional surface texturing.
Figure 18:
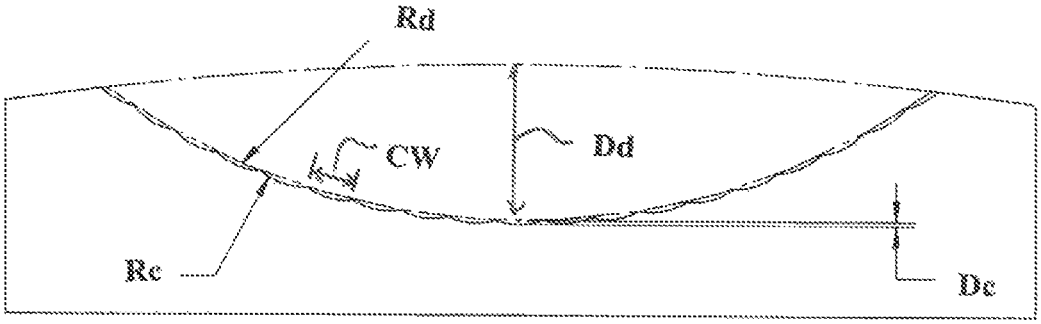
FIG. 18 illustrates a cross-section of a dimple having directional surface texturing.

Each of the dimples on the ball can contain between 3 and 200 linear channels, and more preferably, between 3 and 50 linear channels. Most preferably, the dimples contain between 3 and 25 linear channels. As shown in FIG. 17, the dimple can contain 9 linear channels. In this case, the channel width CW is greater than the length between channels, whereas in FIG. 16, when there are only 3 linear channels, the length between channels is greater than the channel width CW. FIG. 18 illustrates an embodiment where there are 19 linear channels and the linear channels essentially abut one another through the bottom surface of the dimple.

Table II below describes several embodiments of golf balls according to the present invention wherein every dimple has directional surface texturing as described:

TABLE II

| Embodiment | # Dimples | # Channels/ Dimple | Channel Radius (in) | Channel Depth (in) | % Chord Length |
|---|---|---|---|---|---|
| 1 | 352 | 3 | 0.02 | 0.002 | 70 |
| 2 | 352 | 3 | 0.02 (center) | 0.002 | 70 |
| | | | 0.02 (perimeter) | 0.001 | 105 |
| 3 | 352 | 9 | 0.02 | 0.002 | 105 |
| 4 | 328 | 11 | 0.02 | 0.002 | 85 |
| 5 | 328 | 19 | 0.02 | 0.0008 | 95 |

The dimples on a golf ball according to the present invention are preferably circular in plan shape and have a diameters of 0.11 inch to 0.22 inch, but could also be n-sided polygons, where n is between 3 and 10, or other geometric shapes such as those that are defined by periodic functions along a simple path. Preferably, the golf ball has 4 or more diameters of dimples that have multiple dimple depths ranging from 0.005 to 0.03 and edge angles ranging from 10 degrees to 20 degrees.

In a preferred embodiment, each of the dimples on the golf ball has the same number of linear channels. For example, the golf ball can have about 300 to 360 dimples having dimple diameters from 0.11 inch to 0.22 inch. Each of the dimples can contain the same number of linear channels as set forth in Table II above. Preferably, in one embodiment, the width of the channels can vary with dimple diameter such that a dimple having a first diameter that is less than a second diameter of a second dimple has a first channel width that is less than a second channel width. For example, a dimple having a diameter of 0.11 inch can have channel widths of 0.011 inch and a dimple having a diameter of 0.18 inch can have channel widths of 0.018. Thus, the channel widths progressively increase with dimple diameter.

In another embodiment, each dimple on the golf ball has the number of linear channels therein based on the dimple diameter such that a dimple having a first diameter that is less than a second diameter of a second dimple has a first number of channels that is less than a second number of channels in the second dimple. For example, a golf ball can have all of the linear channels having a channel width of 0.02 inch and the number of channels in each dimple is dependent on the dimple diameter. In one example, a dimple having a diameter of 0.11 inch can have 5 linear channels and a dimple having a diameter of 0.18 inch can have 9 linear channels.

Still further, in another embodiment of the present invention, the depth of the linear channels can vary depending on the depth of the dimple. For example, the depths of the linear channels can be a function of dimple depth. In one embodiment, the channel depth can be about 1/10 of the dimple depth such that a dimple having a depth of 0.01 inch has a channel depth of 0.001 inch and a dimple having a depth of 0.02 has a channel depth of 0.002. In another embodiment, the depth of the channels is inversely proportional to the number of channels in a dimple. Thus a dimple can have 3 channels having a first depth and a second dimple can have 11 channels having a second depth that is less than the first depth.

In another preferred embodiment of the present invention the golf ball comprises at least one dimple having a circular plan shape and non-linear directional surface texturing that is comprised of a plurality of channels or protrusions that are non-linear and parallel when viewing the dimple perpendicular to the dimple edge plane as shown in FIGS. 19-24.

Preferably, the channels or protrusions are arcuate, meaning they have an arc radius but the arc spans less than 180 degrees. For example, the arcs of non-linear channels 200, 201 and 202 in FIG. 19 span about 135 degrees. Thus, the present invention excludes channels that create a closed loop within the dimple (such as circles which are 360 degrees, squares, triangles, or other closed paths). As shown in FIGS. 19-24, dimples incorporating non-linear directional surface texturing are specifically directed to parallel line segments such as circular arcs of less than 180 degrees, splines, staggered line segments, etc.

Figure 19:
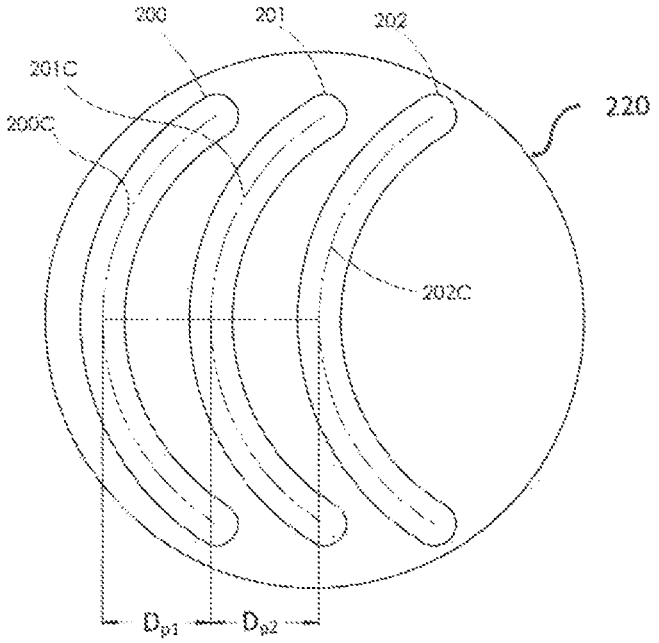
FIG. 19 illustrates a dimple having directional surface texturing.
Figure 20:
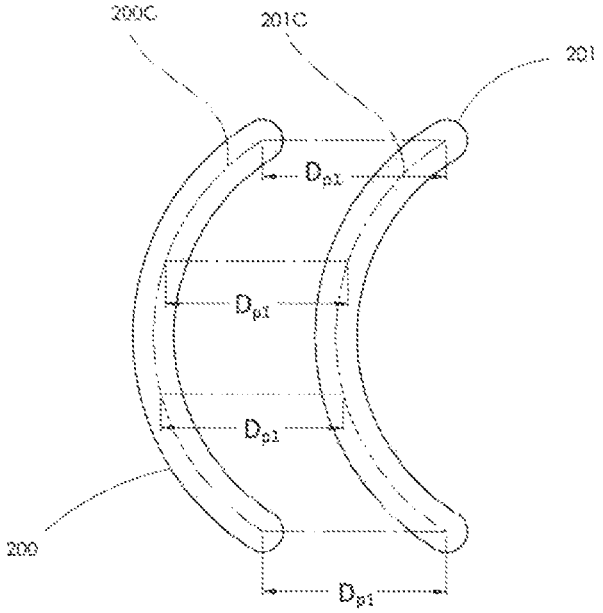
FIG. 20 illustrates the surface texturing of the dimple in FIG. 19.

Referring to FIGS. 19 and 20, the non-linear channels 200, 201 and 202 are determined to be parallel by defining the channel center line, 200C, 201C and 202C, defined by the midpoint between the edges of the channels. Once the center lines 200C, 201C and 202C are defined for two channels, the channels are parallel if the distance between the two channel center lines (the parallel distance $D_p$) is the same for every point along at least one of the channels. For example, the distance $D_{p1}$ shown in FIG. 20 is the same for every point in the channels. Thus, if the channels are the same shape and length the distance between the center lines $D_p$ will be the same for every point along each center line.

As shown in FIGS. 19 and 20, every measurement of the parallel distance $D_{p1}$ and $D_{p2}$ between two channels is substantially equal for the adjacent channels. If the largest parallel distance $D_p$ and the smallest parallel distance $D_p$ between two adjacent channels are substantially equal then the channels are parallel. As shown in FIG. 19, it is preferable that the dimples incorporating non-linear directional surface texturing have a circular plan shape and there are two or more parallel arc-shaped channels. In the dimple shown in FIG. 19, there are three non-linear parallel channels positioned within the perimeter of the dimple 220. All three channels 200, 201 and 202 are circular arcs that span approximately 135 degrees and are the same length. In FIG. 19, first channel 200 has a first channel centerline 200C, second channel 201 has a second channel centerline 201C, and third channel 202 has a third channel centerline 202C. The dimple diameter, D, in this particular example is about 0.15 inches. The channel centerlines are arcs having an arc radii, ar, equal to about 0.067 such that ar=0.45D The channel lengths, channel widths and channel depths for all channels incorporated herein should be as set forth above in reference to FIGS. 2, 16, 17 and 18, including the proportionality to the dimple diameters. More preferably, the channel width for the non-linear channels 200, 201 and 202 are all about 0.012 inches. However, while it is preferred that channel widths and channel depths remain constant within a dimple, it is contemplated that the channel widths and depths can differ by at least 0.002. For example, the channel width for channel 201 could be greater than the channel width for channels 200 and 202. The parallel distance $D_{p1}$ between the first channel 200 and the second channel 201 is approximately 0.03 inches and the parallel distance $D_{p2}$ between the second channel 201 and the third channel 202 is approximately 0.03 inches. However, $D_{p1}$ and $D_{p2}$ do not have to be equal.

FIG. 20 shows a close-up view of channels 200 and 201. There are four separate measurement of the parallel distance $D_{p1}$ at four different points along the channel centerlines 200C and 201C. All four measures of $D_{p1}$ are equal, and therefore, the channels 200 and 201 are parallel.

Figure 21:
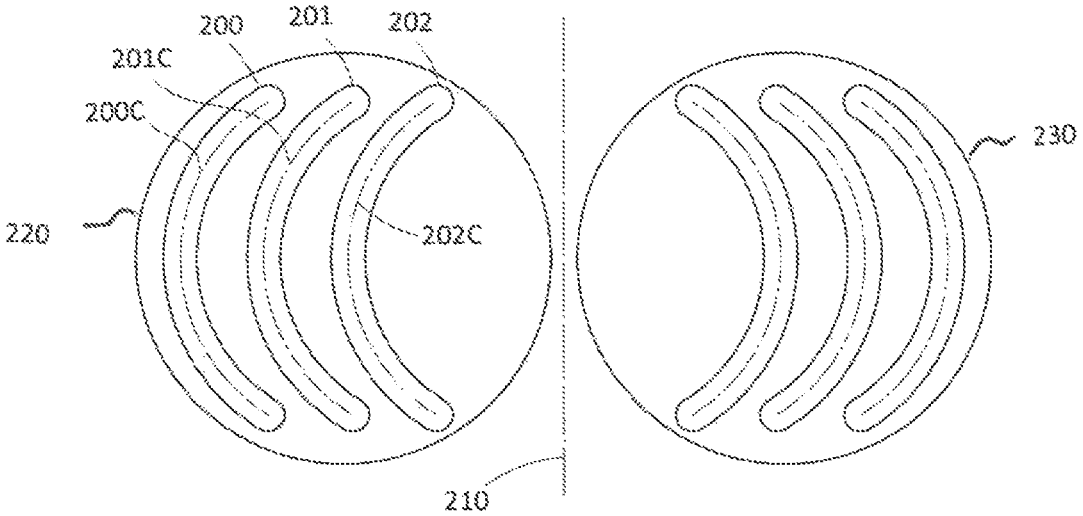
FIG. 21 illustrates multiple dimples having directional surface texturing.
Figure 22:
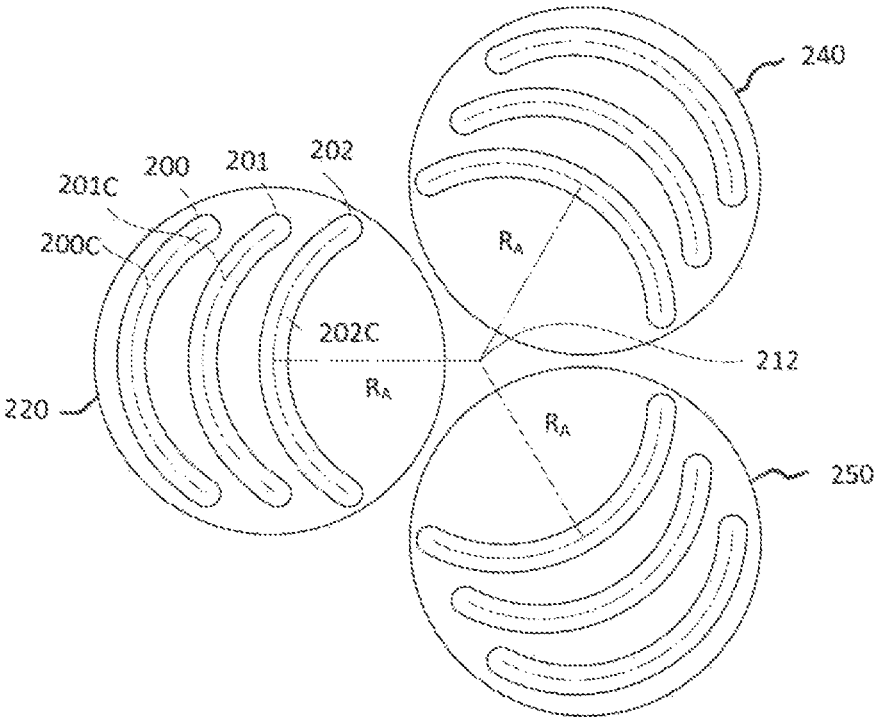
FIG. 22 illustrates multiple dimples having directional surface texturing.

In one particular embodiment of the invention, the dimples incorporating non-linear directional surface texturing having non-linear parallel channels do not have any adjacent dimples having non-linear directional surface texturing. In a further preferred embodiment as shown in FIG. 21, at least two dimples 220 and 230 having non-linear directional surface texturing have mirror symmetry about a centerline 210. In yet a further preferred embodiment as shown in FIG. 22, at least three dimples 220, 240 and 250 having non-linear directional surface texturing are rotationally symmetric about a centroid 212 of the dimples.

Figure 23:
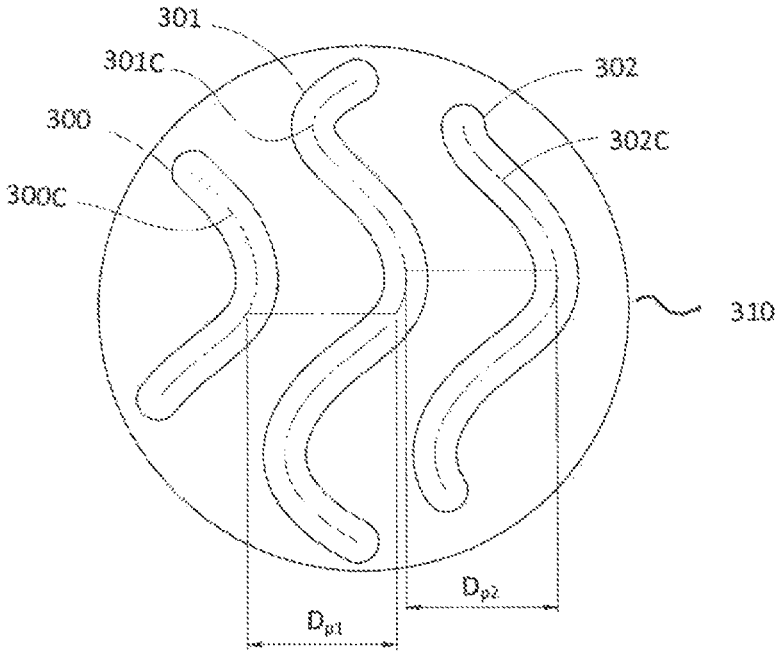
FIG. 23 illustrates a dimple having directional surface texturing.
Figure 24:
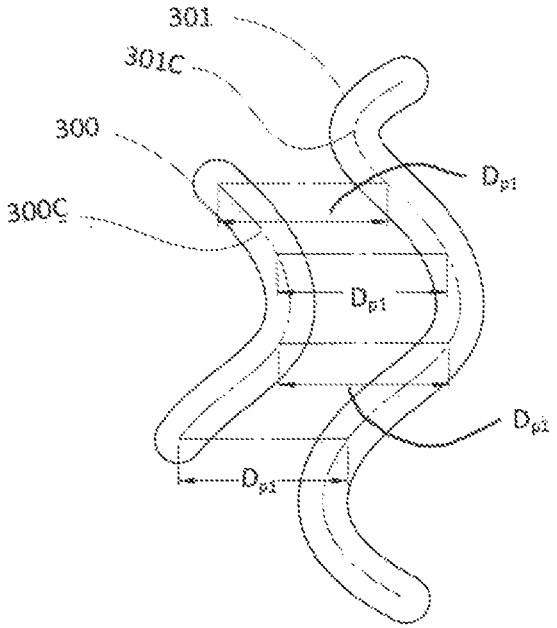
FIG. 24 illustrates the surface texturing of the dimple in FIG. 23.

In another preferred embodiment, the dimples can incorporate non-linear directional surface texturing where the non-linear channels are parallel but one of the lengths is less than the other length. Referring to FIGS. 23 and 24, dimple 310 incorporates parallel, non-linear channels 300, 301 and 302. As set forth above, the distance between the center lines 300C, 301C and 302C will be the same for every point along the shorter channel. Thus, in this case, a portion of the longest channel 301 will not have an equivalent point of measure in channels 300 and 302 and the channels are still considered parallel. In this particular example, the dimple diameter of dimple 310 is about 0.175 inches. The channel centerlines 300C, 301C and 302C are splines (piecewise polynomial parametric curves with all arcs spanning less than 180 degrees) of varying lengths. The channel width for all three channels is approximately 0.014 inches. The parallel distance $D_{p1}$ between the first channel 300 and the second channel 301 is equal to about 0.049 inches and the parallel distance $D_{p2}$ between the second channel 301 and the third channel 302 is equal to 0.049 inches. Again, $D_{p1}$ and $D_{p2}$ do not have to be equal, but are preferably the same.

FIG. 24 is a close-up view of channels 300 and 301. This figure shows four separate measurements of the parallel distance $D_{p1}$ at four different points along the channel centerlines 300C and 301C. All four measures are substantially equal showing that the channels 300 and 301 are parallel. In this example, every point of the centerline 300C has a corresponding point on centerline 301C at a parallel distance of $D_{p1}$, but not every point of 301C will have a corresponding point on 300C due to the centerlines having different lengths.

In a different embodiment, a golf ball of the invention has an outer surface comprising a plurality of dimples, wherein at least one of the dimples comprises three or more linear channels on the surface thereof. Each linear channel has the same channel length L and the same channel width CW; and each of the linear channels extends radially outward in a direction from a centroid of the dimple toward the perimeter of the dimple without intersecting the dimple's centroid. Moreover, the three or more linear channels are spaced by n separation angles $\theta_S$, wherein n is the number of linear channels.

As used herein, the term "centroid" refers to the dimple's center. The term perimeter refers to the outermost edge of a dimple that is adjacent to a land area of the outer surface of the golf ball. Furthermore, a linear channel is considered to extend radially outward within a given dimple if the linear channel's centerline (as depicted, for example, in FIGS. 25, 26*a*, 26*b*, 27 and 28) intersects the dimple's centroid.

The linear channels may form a pattern that is axially symmetric about an axis connecting the centroid of the dimple and the center of the golf ball. Alternatively, the linear channels may form a pattern that is not axially symmetric about an axis connecting the centroid of the dimple and the center of the golf ball.

Separation angles, channel lengths and channel widths of channels of a given dimple are measured in a plane that is normal to an axis connecting the center of the golf ball and the dimple's centroid.

In some embodiments, linear channel origination distance Cd may be closer to the centroid than to the dimple's perimeter. In other embodiments, linear channel origination distance Cd may be closer to the perimeter than to the dimple's centroid.

Herein, two given linear channels are considered to be the same if their channel lengths L vary by 0.002 inches or less and their channel widths CW vary by 0.002 inches or less.

Likewise, two given linear channels are considered to differ if their channel lengths L vary by more than 0.002 inches and/or their channel widths CW vary by more than 0.002 inches.

Dimples preferably have a circular plan shape but may alternatively have a non-circular plan shape. The diameter of a dimple having a circular plan shape is twice the radial distance of a straight line segment that passes through the centroid (the center of the dimple) and whose endpoints lie on the perimeter of the dimple (the circle).

For purposes of the present disclosure, dimples with a non-circular plan shape have an effective dimple diameter defined as twice the average radial distance of the set of points defining the plan shape from the plan shape centroid. It is to be understood that a dimple having a circular plan shape has a circular perimeter, and a dimple having a non-circular plan shape has a non-circular perimeter.

In one embodiment, all n separation angles $\theta_S$ are equal. In another embodiment, at least two of the n separation angles $\theta_S$ differ.

Herein, two given separation angles $\theta_S$ which vary by less than 4.0 degrees when measured on the finished golf ball are considered to be "equal". In turn, two given separation angles $\theta_S$ which vary by 4.0 degrees or greater when measured on the finished golf ball are considered to differ.

In a specific embodiment, none of the channels intersect each other. In one embodiment, at least one linear channel intersects a perimeter of the at least one dimple. In another embodiment, every linear channel intersects a perimeter of the at least one dimple.

In one embodiment, at least one dimple has a perimeter that is circular. In another embodiment, at least one dimple has a perimeter that is non-circular.

In a particular embodiment, channel length L is less than half of dimple diameter and at least two times channel width CW; wherein channel width CW is at least two times channel depth, wherein channel depth is less than or equal to 0.007 inches.

Each of the at least three linear channels extend radially outward from a location on the dimple that is a distance Cd from the dimple's centroid; that is, Cd>0.

At least one dimple may comprise an even number of linear channels; wherein a first half of the linear channels intersect a perimeter of the dimple and a second half of the linear channels does not intersect the perimeter of the dimple; and wherein the first half of the linear channels and the second half of the linear channels alternate about the dimple's centroid.

At least one dimple may comprise nine linear channels; wherein none of the linear channels intersects a perimeter of the dimple, and the wherein linear channels are spaced by a separation angle $\theta_S$ of between 38.0 degrees and 42.0 degrees.

At least one dimple may comprise nine linear channels; wherein each linear channel intersects a perimeter of the dimple, and wherein the linear channels are spaced by a separation angle $\theta_S$ of between 38.0 degrees and 42.0 degrees.

In another embodiment, a golf ball of the invention has an outer surface comprising a plurality of dimples, wherein at least one of the dimples incorporates axially symmetric directional surface texturing comprised of three or more linear channels. At least one of the three or more linear channels has a different channel length L and/or a different channel width CW than at least one other linear channel; and all linear channels extend radially outward without intersecting the dimple's centroid; and linear channels having the same channel length L and the same channel width CW are spaced by n separation angles $\theta_S$, wherein n is the number of linear channels having the same channel length L and the same channel width CW.

In a particular such embodiment, the golf ball comprises a first type of linear channel and a second type of linear channel. Each linear channel of the first type has the same channel length $L_1$ and the same channel width $CW_1$ and extends outward from a location on the dimple that is a distance $Cd_1$ from the dimple's centroid and are spaced by a channel separation angle $\theta_{S1}$.

Meanwhile, each linear channel of the second type has the same channel length $L_2$ and the same channel width $CW_2$ and extends radially outward from a location on the dimple that is a distance $Cd_2$ from the dimple's centroid and are spaced by a channel separation angle $\theta_{S2}$. The first type of linear channel and the second type of linear channel alternate about the dimple's centroid.

In one embodiment, $Cd_1=Cd_2$. In one such embodiment, at least one of $L_1=L_2$ or $CW_1=CW_2$.

In another embodiment, $Cd_2>Cd_1$. In one possible linear channel arrangement, at least one of $L_1=L_2$ or $CW_1=CW_2$. In one specific such embodiment, $Cd_2$ is closer to the perimeter than to the centroid. In another such specific embodiment, $Cd_2$ is closer to the centroid than to the perimeter.

In one embodiment, linear channels of the first type do not intersect a perimeter of the dimple and linear channels of the second type intersect the perimeter of the dimple.

Alternatively, the dimple may comprise ten linear channels comprising five linear channels of the first type and five linear channels of the second type; wherein none of the ten linear channels intersects the perimeter of the dimple; and wherein separation angle $\theta_{S1}$ is between 70 degrees and 74 degrees, and separation angle $\theta_{S2}$ is between 70.0 degrees and 74.0 degrees.

The dimple may comprise twelve linear channels comprising six linear channels of the first type and six linear channels of the second type; wherein each of the twelve linear channels intersects the perimeter; and wherein separation angle $\theta_{S1}$ is between 58.0 degrees and 62.0 degrees and separation angle $\theta_{S2}$ is between 58.0 degrees and 62.0 degrees.

In one such embodiment, separation angle $\theta_{S1}$ is equal to separation angle $\theta_{S2}$. In another such embodiment, separation angle $\theta_{S1}$ is greater than separation angle $\theta_{S2}$.

A given linear channel may be positioned partially or entirely closer to the perimeter than to the dimple's centroid. Alternatively, the given linear channel may be positioned partially or entirely closer to the dimple's centroid than to the dimple's perimeter. Of course, embodiments are envisioned wherein the length of the given linear channel is equally spaced between the centroid and the perimeter. Thus, in one embodiment, a dimple may include three types of linear channels, wherein a first type is positioned on the dimple partially or entirely closer to the perimeter than to the dimple's centroid; a second type is positioned on the dimple partially or entirely closer to the dimple's centroid than to the dimple's perimeter; and a third type is positioned on the dimple such that the length of the dimple is equally spaced between the dimple's centroid and perimeter.

The length, width and depth of each channel are as measured on an unpainted dimple surface. In one embodiment, at least one channel has a paint layer thereon having a thickness that is sufficient to create a channel visual appearance that differs from an adjacent dimple surface visual appearance without changing the golf ball's aerodynamic drag. In an alternative embodiment, at least one channel has a paint layer thereon having a thickness that is sufficient to change the golf ball's aerodynamic drag.

Preferably, the dimples on the ball have a dimple radius of at least 0.2 inch and the linear channels have a channel radius between 0.001 and 0.08 inch, and more preferably 0.007 inch to 0.07 inch. The linear channels are relatively shallow compared to the depth of the dimple they are in, and preferably, have a channel depth of 0.0003 inch to 0.003 inch.

The dimples are preferably circular in plan shape and have a diameters of 0.11 inch to 0.22 inch, but could also be polygonal or other geometric shapes. The dimples can also be spherically shaped in cross section or have a cross section defined by a number of functions. Preferably, the golf ball has four or more diameters of dimples that have multiple dimple depths and edge angles.

In one embodiment, each of the dimples has the same number of linear channels. In another embodiment, each dimple has the same number of linear channels and the channel widths vary according to dimple diameters. In yet another embodiment, the number of linear channels varies based on the dimple diameter. Still further, in another embodiment, the depth of the linear channels can vary depending on the depth of the dimple.

In another preferred embodiment of the present invention the golf ball comprises at least one dimple having a circular plan shape and linear directional surface texturing that is comprised of a plurality of channels that are linear and extending radially outward when viewing the dimple perpendicular to the dimple edge plane.

The length, width and depth of each channel are as measured on an unpainted dimple surface. In one embodiment, at least one channel has a paint layer thereon having a thickness that is sufficient to create a channel visual appearance that differs from an adjacent dimple surface visual appearance without changing the golf ball's drag. In an alternative embodiment, at least one channel has a paint layer thereon having a thickness that is sufficient to change the golf ball's drag.

Several examples of possible radially extending linear channels arrangements for dimples of golf balls of the invention are included in TABLE III below wherein for each linear channel arrangement the number of dimples as well as their respective measurements (widths, lengths and depths) and separation angles are provided as follows:

TABLE III

| Ex. No. | # Channels/ Dimple | Channel Width (in.) | Channel Length (in.) | Channel Depth (in.) | Channel Radius (in.) | Separation Angle $\theta_{S1}$; $\theta_{S2}$ |
|---|---|---|---|---|---|---|
| 1 | 9 | 0.014 | 0.067 | 0.002 | 0.016 | 40 |
| 2 | 10 | 0.014 | 0.067 | 0.002 | 0.016 | 72 |
| | | 0.011 | 0.031 | 0.001 | 0.016 | 72 |
| 3 | 12 | 0.014 | 0.076 | 0.002 | 0.016 | 60 |
| | | 0.015 | 0.056 | 0.002 | 0.016 | 60 |
| 4 | 9 | 0.014 | 0.076 | 0.002 | 0.016 | 40 |

Figure 25:
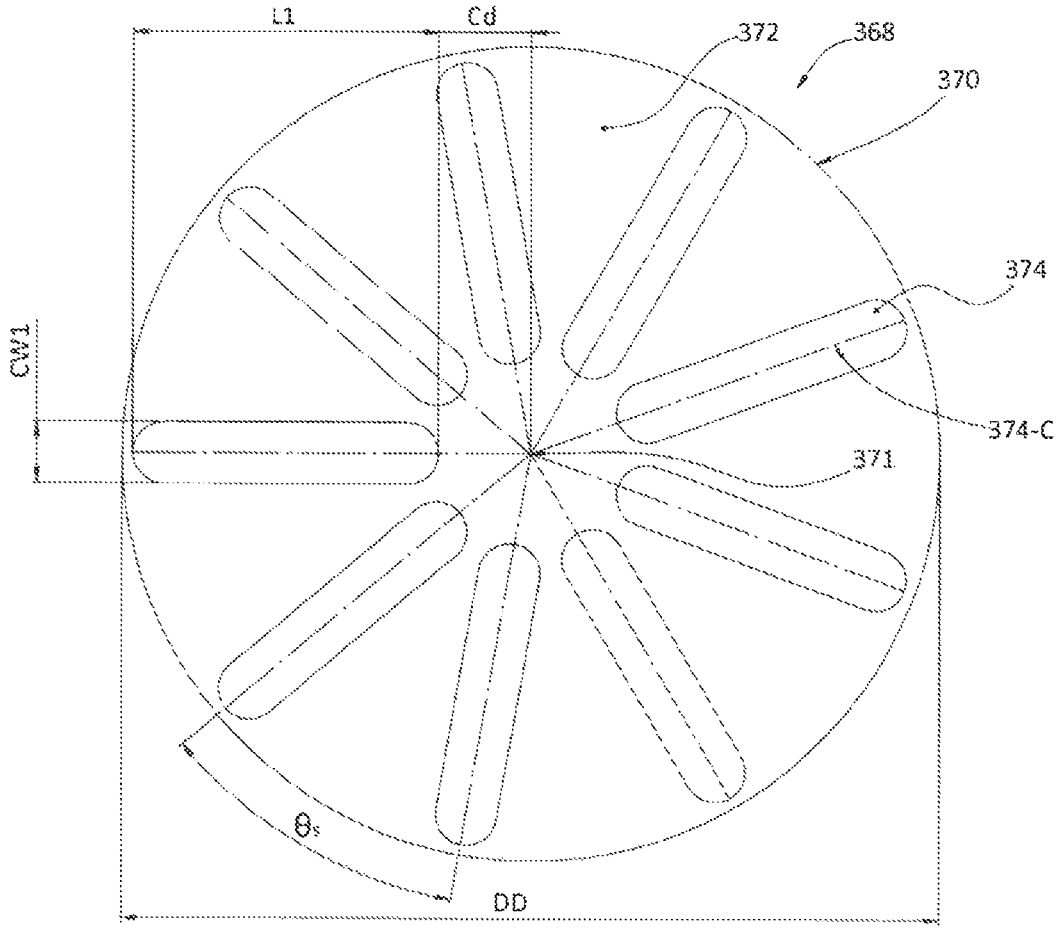
FIG. 25 illustrates a dimple having directional surface texturing.

Referring to dimple channel arrangement example Ex.1 of TABLE III in connection with FIG. 25, dimple 368 has a perimeter 370, a dimple diameter DD of about 0.180 inches, and a dimple surface 372. Dimple surface 372 is spherical, has an edge angle of about 14.25 degrees, and contains nine linear channels 374, each having the dimensions set forth in TABLE I. None of nine linear channels 374 intersect dimple perimeter 370, and each has a center line 374-C between which there is a channel separation angle $\theta_S$ such that all of the channels are rotationally symmetric about an axis connecting a center of the golf ball to dimple centroid 371. Also, none of the nine linear channels 374 intersects centroid 371 but rather, are each extends radially outward from a location on the dimple that is a distance Cd from the dimple's centroid 371.

Figure 26A:
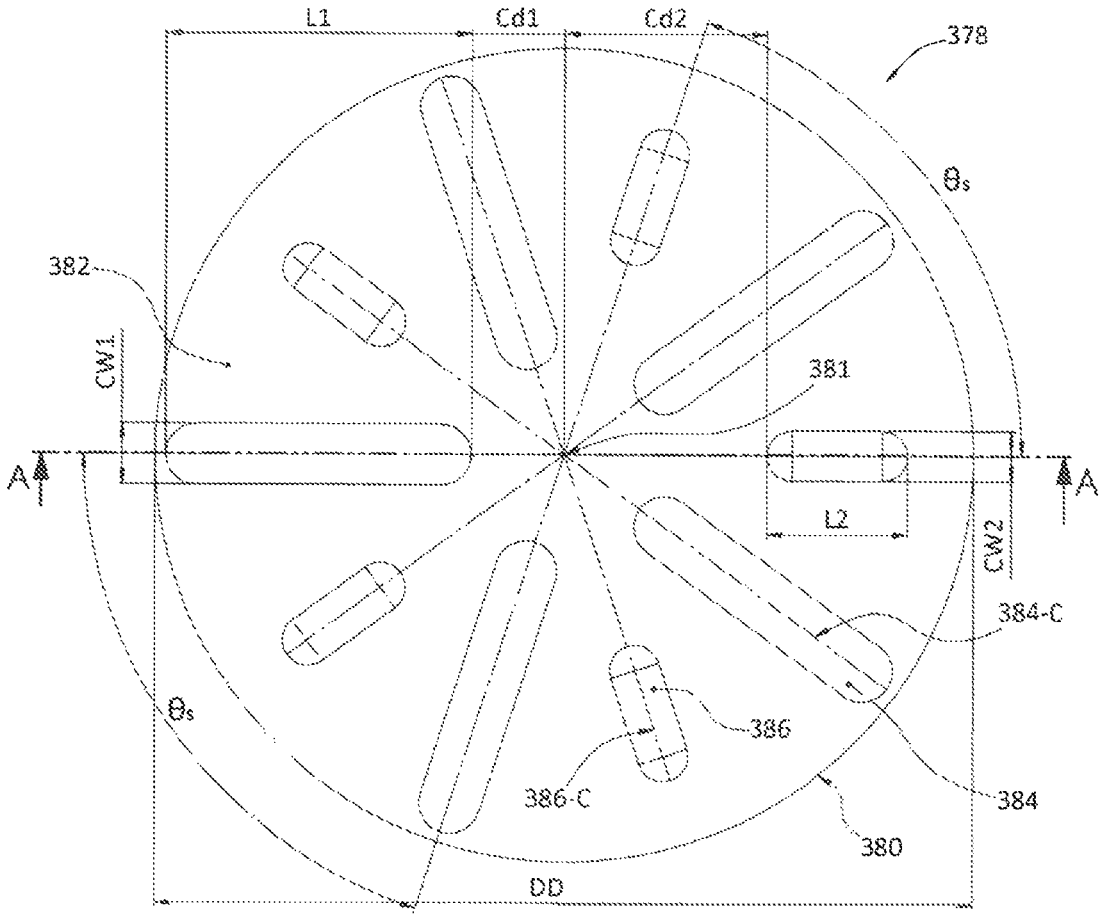
FIG. 26*a* illustrates a dimple having directional surface texturing.
Figure 26B:
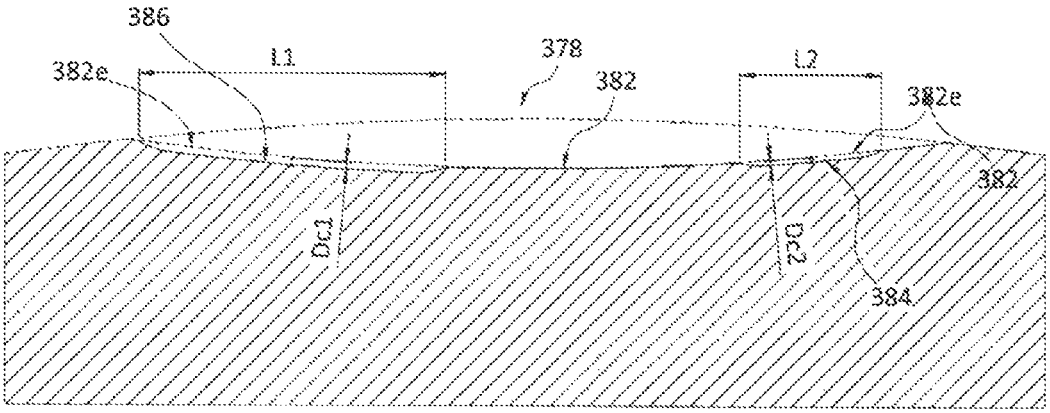
FIG. 26*b* illustrates a linear channel having constant channel depth within a dimple.

Meanwhile, referring to dimple channel arrangement example Ex. 2 of TABLE III in connection with FIGS. 26*a* and 26*b*, dimple 378 has a perimeter 380, a dimple diameter DD of about 0.180 inches, and a dimple surface 382. Dimple surface 382 is spherical, has an edge angle of about 14.25 degrees, and contains ten linear channels including a first type of five linear channels 384 and a second type of five linear channels 386. Linear channels 384 and linear channels 386 are all contained within the entirety of the dimple perimeter (that is, none of the ten channels intersect dimple perimeter 380). Consecutive center lines 84-C of the first type of linear channels 384 are separated by a channel separation angle $\theta_{S1}$ such that all of the channels are rotationally symmetric about an axis connecting the center of the ball to the dimple centroid 381. In turn, consecutive center lines 86-C of the second type of linear channels 386 are separated by a channel separation angle $\theta_{S2}$ such that all of the channels are rotationally symmetric about an axis connecting the center of the ball to the dimple centroid 381. The first channel type and second channel type have different dimensions as shown in TABLE III.

Moreover, none of the ten linear channels 384 and 386 intersects centroid 381. Instead, each of linear channels 384 extends radially outward from a location on the dimple that is a distance $Cd_1$ from the dimple's centroid 381, while each of linear channels 386 extends radially outward from a location on the dimple that is a distance $Cd_2$ from the dimple's centroid 381. In this embodiment, $Cd_1$ is closer to centroid 381 than to perimeter 380. In some such embodiments, $Cd_2$ may also be closer to centroid 381 than to perimeter 380. Alternatively, $Cd_2$ may be closer to perimeter 380 than to centroid 381. Of course, embodiments are also envisioned wherein $Cd_2$ is equidistant from centroid 381 and perimeter 380. And embodiments are indeed also possible wherein both $Cd_1$ and $Cd_2$ are closer to perimeter 380 than to centroid 381; or both $Cd_1$ and $Cd_2$ are equidistant from centroid 381 and perimeter 380.

Furthermore, it is evident from FIG. 26*b* that both types of linear channels 384 and 386 have constant channel depths $Dc_1$ and $Dc_2$, respectively, extending below extrapolated surface 382*e* which continues between surfaces 382 of dimple 378.

Figure 27:
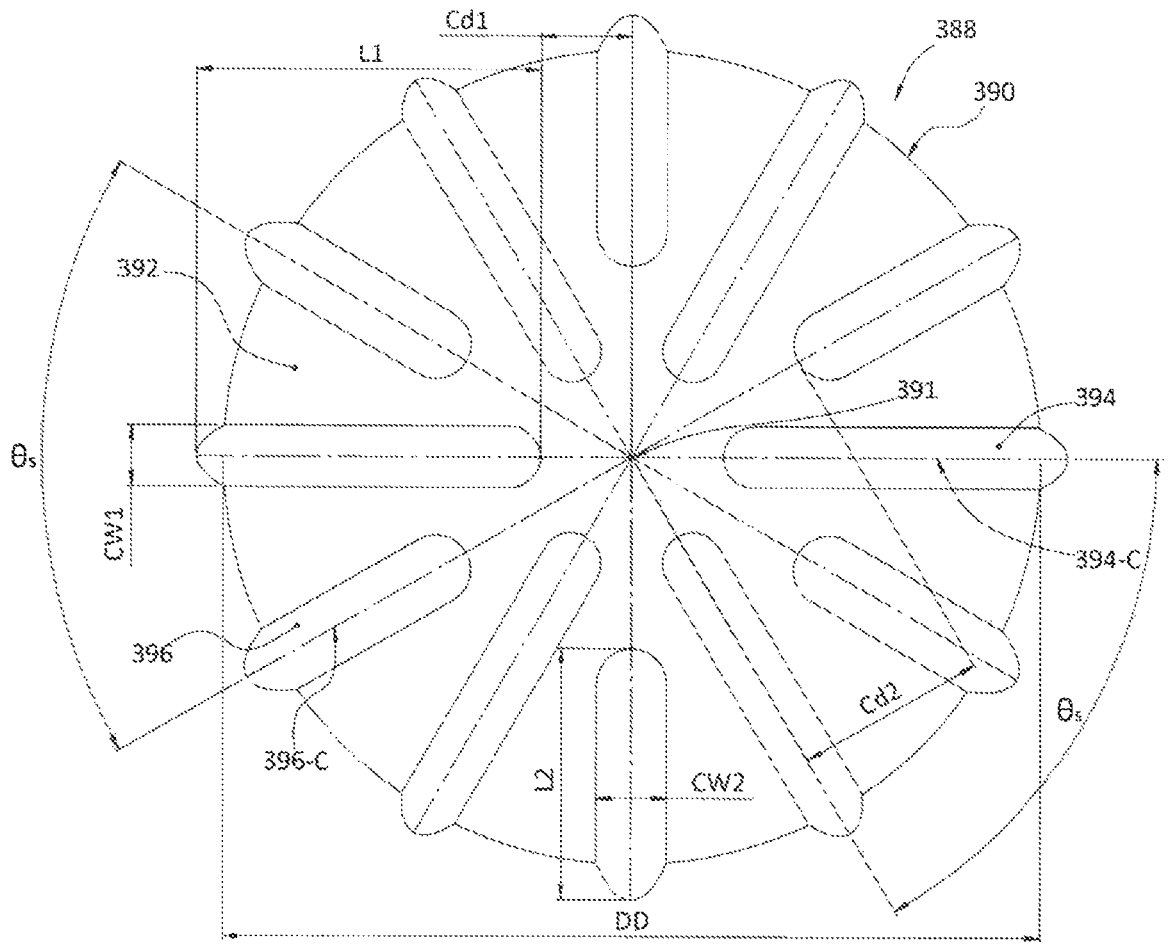
FIG. 27 illustrates a dimple having directional surface texturing.

Referring next to dimple channel arrangement example Ex.3 of TABLE III in connection with FIG. 27, dimple 388 has a perimeter 390, a dimple diameter DD of about 0.180 inches, and a dimple surface 392. Dimple surface 392 is spherical, has an edge angle of about 14.25 degrees, and contains twelve linear channels including a first type of six linear channels 394 and a second type of six linear channels 396. Linear channels 394 and linear channels 396 all intersect dimple perimeter 390. Consecutive center lines 394-C of the first type of linear channels 394 are separated by a channel separation angle $\theta_{S1}$ such that all of the channels are rotationally symmetric about an axis connecting the center of the ball to the dimple centroid 391. In turn, consecutive center lines 396-C of the second type of linear channels 396 are separated by a channel separation angle $\theta_{S2}$ such that all of the channels are rotationally symmetric about an axis connecting the center of the ball to the dimple centroid 391. The first channel type and second channel type have different dimensions as shown in TABLE III.

Moreover, none of the ten linear channels 394 and 396 intersects centroid 391. Instead, each of linear channels 394 extends radially outward from a location on the dimple that is a distance $Cd_1$ from the dimple's centroid 391, while each of linear channels 396 extends radially outward from a location on the dimple that is a distance $Cd_2$ from the dimple's centroid 391.

Figure 28:
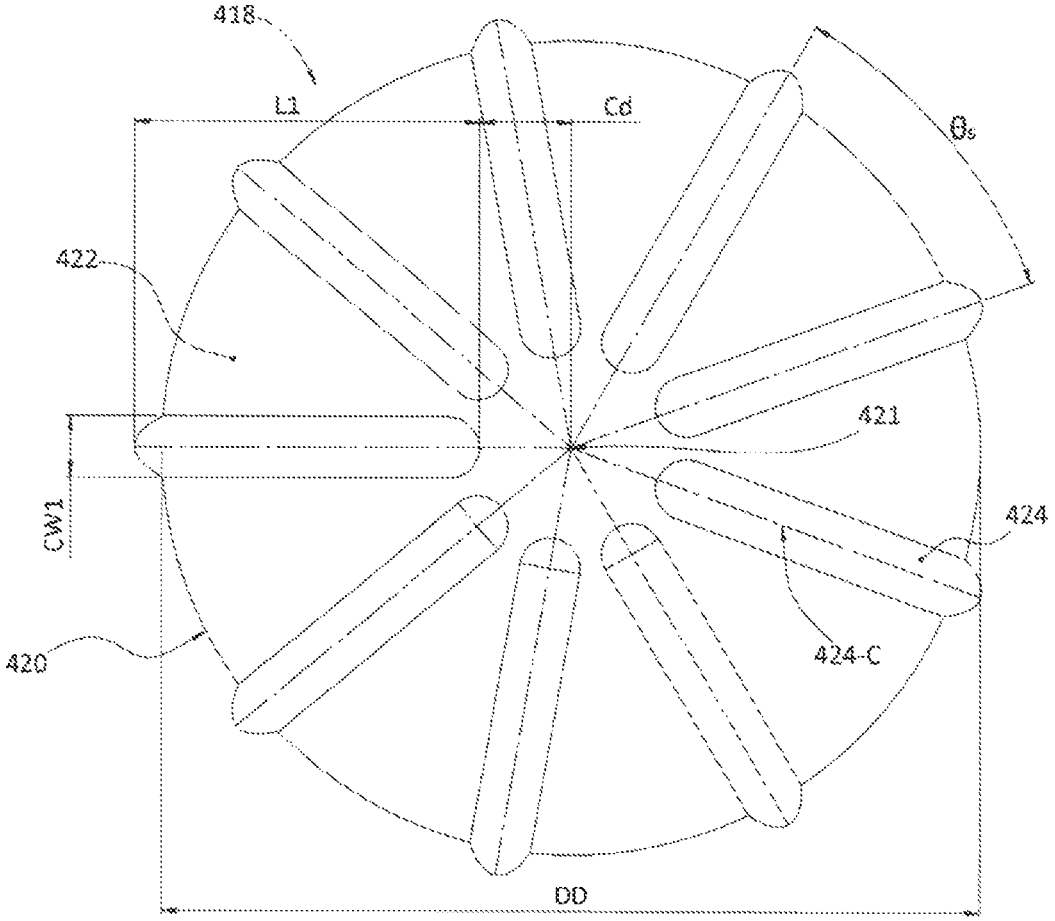
FIG. 28 illustrates a dimple having directional surface texturing.

Finally, referring to dimple channel arrangement example Ex.4 of TABLE III in connection with FIG. 28, dimple 418 has a perimeter 420, a dimple diameter DD of about 0.180 inches, and a dimple surface 422. Dimple surface 422 is spherical, has an edge angle of about 14.25 degrees, and contains nine linear channels 424, each having the dimensions set forth in TABLE I. Each of nine linear channels 424 intersect dimple perimeter 420, and each has a center line 424-C between which there is a channel separation angle $\theta_S$ such that all of the channels are rotationally symmetric about an axis connecting a center of the golf ball to dimple centroid 421. Additionally, none of the nine linear channels 424 intersects centroid 421 but rather, each extends radially outward from a location on the dimple that is a distance Cd from the dimple's centroid 421.

FIGS. 25-28 also demonstrate that width (CW1) of each linear channel is constant with respect to center lines 374-C, 384-C, 394-C and 424-C, respectively.

Thus, at least one dimple of golf balls of the invention incorporates axially symmetric directional surface texturing comprised of three or more linear channels which extend radially outward from the dimple's centroid without intersecting it; and wherein meanwhile, consecutive same-type linear channels are separated by a channel separation angle $\theta_{Sn}$, wherein n is a designation distinguishing different channel types. For example where a given dimple includes first and second different channel types, channel separation angle $\theta_{S1}$ can be used to represent the separation angles between consecutive channels of the first channel type, and separation angle $\theta_{S2}$ can be used to represent the separation angles between consecutive channels of the second channel type.

In this regard, the channels of a given dimple may have the same or different measurements; intersect or not intersect each other and/or a perimeter of the dimple. Dimple perimeter may be circular or non-circular. All channel separation angles $\theta_S$ may be the same, or, alternating channel separation angles $\theta_S$ may be the same. For example, a dimple may have a first type of linear channels and a second type of linear channels, wherein the two types have different channel widths and channel lengths; and wherein channel separation angles $\theta_{S1}$ between consecutive first type channels differs from channel separation angle $\theta_{S2}$ between consecutive second type channels.

While in preferred embodiments a given dimple incorporates one channel type or two differing channel types, it is envisioned that a dimple may contain any number of differing channel types possible for a given dimple surface area and perimeter measurement.

And preferably, a dimple incorporates at least three linear channels.

The length of a given linear channel is preferably less than one half of the dimple's diameter DD and does not intersect the dimple's centroid. Meanwhile, the linear channel's length is preferably twice channel width, which in turn, is preferably twice channel depth, where the channel's depth is preferably equal to or less than 0.007 inches.

Thus, in one non-limiting example, a linear channel may have a depth of 0.007 inches, a width of 0.014 inches or greater, and a length of 0.028 inches or greater. In another non-limiting example, a linear channel may have a depth of 0.006 inches, a width of 0.012 inches or greater, and a length of 0.024 inches or greater. In yet another non-limiting example, a linear channel may have a depth of 0.005 inches, a width of 0.010 or greater, and a length of 0.020 inches or greater. In still another non-limiting example, a linear channel may have a depth of 0.004 inches, a width of 0.008 inches or greater, and a length of 0.016 inches or greater. In an alternative embodiment, a linear channel may have a depth of 0.003 inches, a width of 0.006 inches or greater, and a length of 0.012 inches or greater. In a different embodiment, a linear channel may have a depth of 0.002 inches, a width of 0.004 inches or greater, and a length of 0.008 inches or greater. Or, a linear channel may have a depth of 0.001 inches, a width of 0.002 inches or greater, and a length of 0.004 inches or greater.

Golf balls of the invention may include dimples having many different radially outward extending linear channel arrangements consistent with the disclosure herein. For example, a dimple may include two different channel types, a first type having a separation angle $\theta_{S1}$ and a second type having a separation angle $\theta_{S2}$ which alternate about the centroid in predetermined pattern. Channels of the second type may for example have a channel separation angle $\theta_{S2}$ that is greater than channel separation angle $\theta_{S1}$ of the first type. In a specific such embodiment, the dimple may include six linear channels of the first type and three linear channels of the second type, wherein two of the six linear channels of the first type are located/positioned between consecutive linear channels of the second type. In this embodiment, separation angle $\theta_{S2}$ between the second type of linear channels is 120°. And two given linear channels of the first type that are positioned between consecutive linear channels of the second type are separated by a separation angle $\theta_{S1}$ of 40° when measured between center lines of consecutive channels of the same type. In this embodiment, not all linear channels of the first type have the same separation angle of 40°. Any two given linear channels of the first type having a linear channel of the second type positioned there between have a separation angle of 80° in this embodiment.

If instead, a dimple contains nine linear channels of the first type and three linear channels of the second type, then three of the nine linear channels of the first type may be located between consecutive linear channels of the second type. In this embodiment, separation angle $\theta_{S2}$ between the second type of linear channels is still 120°, whereas $\theta_{S1}$ between the first type of linear channels is 30°, and any two given linear channels of the first type having a linear channel of the second type positioned there between have a separation angle of 60° in this embodiment.

Accordingly, golf balls of the invention can produce a wide range of unique primary aerodynamic behavior and flight characteristics, unique secondary aerodynamic behaviors, and visually distinct appearances, by preselecting any and all of i) the total number of such dimples included on/within the golf ball's outer surface; ii) the total number of linear channels included on such a dimple (≥3); iii) the sizing (e.g. length/width) of each linear channel on/in such a dimple; and iv) the locations of the linear channels on such a dimple and the spacing (separation angle $\theta_S$) there between.

Generally, a dimple may include either of an odd total number of linear channels or an even total number of linear channels. In embodiments wherein a given dimple comprises two or more types of linear channels, the dimple may include an odd number of each type of linear channel, an even number of each type of linear channel, or an odd number of one or more types of linear channels and an even number of one or more types of linear channels.

And all linear channels can be equally spaced (separation angle $\theta_S$) on/within the dimple (about the centroid); or be unequally spaced on/within the dimple (that is, at least two separation angles $\theta_S$ differ); or a combination thereof.

The at least three linear channels always extend radially outward from the dimple's centroid without intersecting it. The at least three linear channels may all have the same linear channel lengths and/or linear channel widths, and/or distances from the centroid. Alternatively, at least one linear channel may differ from at least one other linear channel with respect to any or each of linear channel length and/or linear channel width, and/or distance from the centroid.

Furthermore, two given linear channels may extend radially outward from locations on the dimple's surface that are the same radial distance from the centroid and also closer to the centroid than to the perimeter. Alternatively, two given linear channels may extend radially outward from locations on the dimple's surface that are different radial distances from the centroid but still both be closer to the centroid than to the perimeter. It is also contemplated that in some embodiments, two given linear channels may extend radially outward from locations on the dimple's surface that are both closer to the perimeter than to the centroid; and in such embodiments, it is envisioned that their respective radial distances from the centroid may be the same or differ.

In any of these embodiments, one or more linear channel may intersect the perimeter. Alternatively, in any of these embodiments, it is possible to construct the dimple such that none of the linear channels intersect the perimeter.

None of the linear channels on a given dimple intersect since each extends radially outward in relation to the dimple's centroid but does not intersect the centroid. Furthermore, a given linear channel is located on/within a single dimple and does not extend beyond that dimple into the land area of the outer surface of the golf ball nor into/onto another dimple and therefore does not intersect any linear channel of another dimple.

This being said, a golf ball of the invention may additionally contain one or more dimples having profiles and channel arrangements as also disclosed herein and/or in any parent application(s) referred to in the Cross-Reference and each of which is hereby incorporated herein by reference in its entirety.

When numerical lower limits and numerical upper limits are set forth herein, it is contemplated that any combination of these values may be used. All numerical values and ranges set forth herein are approximate.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. For example, the dimples discussed herein are shown as circular dimples. However, it is understood that the present invention is intended to cover polygonal shaped dimples such as, for example, those disclosed in U.S. Pat. Nos. 7,722,484 and 7,867,109, which are incorporated by reference herein in their entirety. Further embodiments above are described with respect to including linear channels. However, it is easily appreciated that the channels can be formed as protrusions as well. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having an outer surface comprising a plurality of dimples, wherein at least one of the dimples comprises nine linear channels on the surface thereof;

wherein each of the nine linear channels extends radially outward in a direction from the centroid of the dimple toward the perimeter of the dimple without intersecting the dimple's centroid; and wherein the nine linear channels include six linear channels of a first type and three linear channels of a second type, each linear channel of the first type having the same channel length $L_1$ and the same channel width $CW_1$, and each linear channel of the second type having the same channel length $L_2$ and the same channel width $CW_2$; wherein $L_1 \neq L_2$; and wherein each two linear channels of the first type are located between consecutive linear channels of the second type; and wherein linear channels of the second type are spaced about the centroid by the same separation angle $\theta_{S2}$ of 120°.

2. The golf ball of claim 1, wherein the linear channels form a pattern that is axially symmetric about an axis connecting the centroid of the dimple and the center of the golf ball.

3. The golf ball of claim 1, wherein none of the linear channels intersect each other.

4. The golf ball of claim 1, wherein at least the linear channels of a second type intersect the perimeter of the dimple.

5. The golf ball of claim 1, wherein every linear channel intersects the perimeter of the dimple.

6. The golf ball of claim 1, wherein the dimple has a circular plan shape.

7. The golf ball of claim 1, wherein the dimple has a non-circular plan shape.

8. The golf ball of claim 1, wherein each of the channel length $L_1$ and the channel length $L_2$ is less than half of dimple diameter and at least two times the channel width CW; wherein the channel width CW is at least two times the channel depth; and wherein the channel depth is less than or equal to 0.007 inches.

9. The golf ball of claim 1, wherein $CW_1 = CW_2$.

10. The golf ball of claim 1, wherein $CW_1 \neq CW_2$.

11. A golf ball having an outer surface comprising a plurality of dimples, wherein at least one of the dimples comprises ten linear channels on the surface thereof; the ten linear channels comprising five linear channels of a first type and five linear channels of a second type; wherein each of the linear channels extends radially outward in a direction from the centroid of the dimple toward the perimeter of the dimple without intersecting the dimple's centroid; and wherein each linear channel of the first type has the same channel length $L_1$ and the same channel width $CW_1$, and each linear channel of the second type has the same channel length $L_2$ and the same channel width $CW_2$; wherein $L_1 \neq L_2$ and/or $CW_1 \neq CW_2$;

wherein the first type of linear channel and second type of linear channel alternate about the centroid of the dimple; and wherein none of the ten linear channels intersect the perimeter of the dimple; and wherein the linear channels of the first type are spaced about the centroid by the same separation angle $\theta_{S1}$ of 72.0 degrees, and wherein linear channels of the second type are spaced about the centroid by the same separation angle $\theta_{S2}$ of 72.0 degrees.

12. The golf ball of claim 11, wherein each linear channel of the first type has the same minimum distance $Cd_1$ from the linear channel to the centroid of the dimple, each linear channel of the second type has the same minimum distance $Cd_2$ from the linear channel to the centroid of the dimple, and $Cd_1 = Cd_2$.

13. The golf ball of claim 11, wherein each linear channel of the first type has the same minimum distance $Cd_1$ from the linear channel to the centroid of the dimple, each linear channel of the second type has the same minimum distance $Cd_2$ from the linear channel to the centroid of the dimple, and $Cd_1 \neq Cd_2$.

14. The golf ball of claim 11, wherein $L_1 = L_2$ or $CW_1 = CW_2$.

15. A golf ball having an outer surface comprising a plurality of dimples, wherein at least one of the dimples comprises twelve linear channels on the surface thereof; the twelve linear channels comprising six linear channels of a first type and six linear channels of a second type; wherein each of the linear channels extends radially outward in a direction from the centroid of the dimple toward the perimeter of the dimple without intersecting the dimple's centroid; and wherein each linear channel of the first type has the same channel length $L_1$ and the same channel width $CW_1$, and each linear channel of the second type has the same channel length $L_2$ and the same channel width $CW_2$; wherein $L_1 \neq L_2$ and/or $CW_1 \neq CW_2$; wherein the first type of linear channel and second type of linear channel alternate about the centroid of the dimple; and wherein each of the twelve linear channels intersect the perimeter; and wherein linear channels of the first type are spaced about the centroid by the same separation angle $\theta_{S1}$ of 60.0 degrees; and linear channels of the second type are spaced about the centroid by the same separation angle $\theta_{S2}$ of 60.0 degrees.

16. The golf ball of claim 15, wherein each linear channel of the first type has the same minimum distance $Cd_1$ from the linear channel to the centroid of the dimple, each linear channel of the second type has the same minimum distance $Cd_2$ from the linear channel to the centroid of the dimple, and $Cd_1 = Cd_2$.

17. The golf ball of claim 15, wherein each linear channel of the first type has the same minimum distance $Cd_1$ from the linear channel to the centroid of the dimple, each linear channel of the second type has the same minimum distance $Cd_2$ from the linear channel to the centroid of the dimple, and $Cd_1 \neq Cd_2$.

18. The golf ball of claim 15, wherein $L_1 = L_2$ or $CW_1 = CW_2$.

* * * * *